US008485201B2

(12) United States Patent
Wyatt et al.

(10) Patent No.: US 8,485,201 B2
(45) Date of Patent: Jul. 16, 2013

(54) COSMETIC APPLICATOR WITH TORQUE LIMITER

(75) Inventors: Peter Jonathan Wyatt, Forest Hill, MD (US); David Edward Wilson, Reisterstown, MD (US); Donald Frank Rainey, Owings Mills, MD (US); Tamela Suzanne Jadin, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 293 days.

(21) Appl. No.: 11/677,338

(22) Filed: Feb. 21, 2007

(65) Prior Publication Data

US 2008/0196735 A1 Aug. 21, 2008

(51) Int. Cl.
*A45D 40/26* (2006.01)

(52) U.S. Cl.
USPC ..... 132/218

(58) Field of Classification Search
USPC ..... 173/146; 132/218, 317, 313; 60/330; 192/147, 129 R, 116.5, 225, 12 A, 48.602, 192/56.3, 56.31
See application file for complete search history.

(56) References Cited

U.S. PATENT DOCUMENTS

| | | | | |
|---|---|---|---|---|
| 386,453 | A | | 7/1888 | Roberts |
| 474,795 | A | | 5/1892 | Hantman |
| 2,290,454 | A | | 7/1942 | Leon |
| D145,158 | S | | 7/1946 | Derham |
| D154,653 | S | | 8/1949 | Beckler |
| 2,625,157 | A | | 1/1953 | Lockhart |
| D185,339 | S | | 5/1959 | Wolff |
| 2,975,467 | A | | 3/1961 | Stanzel |
| 3,132,743 | A | | 5/1964 | Wolff |
| 3,156,335 | A | | 11/1964 | Richard |
| 2,154,812 | A | | 4/1967 | Hauser |
| 3,431,571 | A | | 3/1969 | Kraus |
| 3,432,069 | A | | 3/1969 | Craig |
| 3,661,018 | A | | 5/1972 | Keefer |
| 3,699,952 | A | | 10/1972 | Waters |
| 3,998,235 | A | | 12/1976 | Kingsford |
| 4,056,111 | A | * | 11/1977 | Mantelet ..... 132/218 |
| 4,186,733 | A | | 2/1980 | Mogaki |
| 4,302,901 | A | | 12/1981 | Psyras |

(Continued)

FOREIGN PATENT DOCUMENTS

| | | |
|---|---|---|
| CH | 585047 | 2/1977 |
| CH | 609238 | 2/1979 |

(Continued)

OTHER PUBLICATIONS http://coolmagnetman.com/magtypes.html.*

(Continued)

*Primary Examiner* — Todd Manahan
*Assistant Examiner* — Brianne Kalach
(74) *Attorney, Agent, or Firm* — Charles R. Ware; John G. Powell; Megan C. Hymore

(57) ABSTRACT

A cosmetic applicator includes a handle, a drive coupled to the handle, an applicator head coupled to the drive, and a torque limiter. The torque limiter includes a magnetic coupling, the magnetic coupling being coupled to at least one of the drive and the applicator head such that the torque applied via the applicator head does not exceed a predetermined allowable torque.

20 Claims, 31 Drawing Sheets

U.S. PATENT DOCUMENTS

| | | | | |
|---|---|---|---|---|
| 4,370,771 | A | 2/1983 | Gonzalvo | |
| 4,397,326 | A | 8/1983 | Formica | |
| 4,428,338 | A | 1/1984 | Skatsche | |
| D272,952 | S | 3/1984 | Holloway | |
| 4,490,877 | A | 1/1985 | Drumm | |
| 4,498,490 | A | 2/1985 | Seidler | |
| 4,632,136 | A | 12/1986 | Kingsford | |
| 4,679,271 | A | 7/1987 | Field | |
| 4,687,364 | A | 8/1987 | Kingsford | |
| 4,691,720 | A | 9/1987 | Schmitz | |
| 4,698,869 | A | 10/1987 | Mierau | |
| 4,744,377 | A | 5/1988 | Dolan, Jr. | |
| 4,766,432 | A | 8/1988 | Field | |
| D304,095 | S | 10/1989 | Gavin | |
| D306,967 | S | 4/1990 | Matsuura | |
| 4,914,988 | A | 4/1990 | Chang | |
| 4,922,934 | A | 5/1990 | Gatti | |
| 4,974,980 | A | 12/1990 | Gueret | |
| 4,988,502 | A | 1/1991 | Ounanian et al. | |
| 5,007,442 | A | 4/1991 | Hirzel | |
| 5,061,103 | A | 10/1991 | Walsh-Smith | |
| 5,078,157 | A | 1/1992 | Golan et al. | |
| 5,086,793 | A | 2/1992 | Kingsford | |
| 5,172,992 | A | 12/1992 | Ackermann | |
| 5,186,728 | A | 2/1993 | Fong | |
| 5,189,751 | A | 3/1993 | Giuliani et al. | |
| 5,253,382 | A | 10/1993 | Beny | |
| 5,263,218 | A | 11/1993 | Giuliani et al. | |
| 5,372,444 | A | 12/1994 | Lhuisset | |
| 5,378,153 | A | 1/1995 | Giuliani et al. | |
| 5,383,242 | A | 1/1995 | Bigler | |
| 5,407,093 | A | 4/1995 | McGill | |
| D358,294 | S | 5/1995 | Letica | |
| 5,435,034 | A | 7/1995 | Bigler | |
| 5,492,136 | A | 2/1996 | Edmonds | |
| 5,575,579 | A | 11/1996 | Joulia | |
| D383,980 | S | 9/1997 | Abfier | |
| 5,784,742 | A | 7/1998 | Giuliani | |
| 5,794,296 | A | 8/1998 | Wong | |
| 5,816,728 | A | 10/1998 | Nardolillo et al. | |
| 5,822,821 | A | 10/1998 | Sham | |
| 5,864,911 | A | 2/1999 | Arnoux et al. | |
| D408,283 | S | 4/1999 | Tucker | |
| D409,800 | S | 5/1999 | Litton | |
| 5,937,871 | A | 8/1999 | Clay | |
| 5,956,791 | A | 9/1999 | Bassi | |
| D420,767 | S | 2/2000 | Coates | |
| D424,937 | S | 5/2000 | Tucker | |
| 6,142,692 | A | 11/2000 | Garcia | |
| 6,145,514 | A | 11/2000 | Clay | |
| 6,199,242 | B1 | 3/2001 | Masterman | |
| 6,295,994 | B1 | 10/2001 | Thayer et al. | |
| 6,345,626 | B1 | 2/2002 | Bouix | |
| RE37,605 | E | 3/2002 | Clay | |
| 6,412,496 | B1 | 7/2002 | Gueret | |
| 6,450,178 | B1 | 9/2002 | Clay | |
| 6,454,674 | B1 | 9/2002 | Krzesicki et al. | |
| 6,565,276 | B1 | 5/2003 | Diaz | |
| 6,652,888 | B2 | 11/2003 | Rhoades | |
| 6,691,716 | B2 | 2/2004 | Neuner et al. | |
| 6,811,340 | B2 | 11/2004 | Petit | |
| 6,948,780 | B1 | 9/2005 | Litman et al. | |
| 7,025,068 | B2 | 4/2006 | Dumler | |
| 7,089,946 | B2 | 8/2006 | Rousselet | |
| D530,857 | S | 10/2006 | Black | |
| 7,165,906 | B2 | 1/2007 | Dieudonat et al. | |
| D548,973 | S | 8/2007 | Dawson | |
| D550,078 | S | 9/2007 | Henry | |
| 2001/0018061 | A1 | 8/2001 | Rhoades | |
| 2001/0046506 | A1 | 11/2001 | Rhoades | |
| 2001/0050089 | A1 | 12/2001 | Fitjer | |
| 2002/0069726 | A1 | 6/2002 | Adler et al. | |
| 2002/0157680 | A1* | 10/2002 | Postal et al. | 132/75.8 |
| 2002/0195117 | A1 | 12/2002 | Bailly | |
| 2003/0165550 | A1 | 9/2003 | Rhoades | |
| 2004/0195063 | A1 | 10/2004 | Simonis et al. | |
| 2004/0234323 | A1 | 11/2004 | Albisetti et al. | |
| 2004/0244809 | A1 | 12/2004 | Gueret | |
| 2005/0086752 | A1 | 4/2005 | Lee | |
| 2005/0142093 | A1 | 6/2005 | Skover | |
| 2005/0250076 | A1 | 11/2005 | Rhoades | |
| 2005/0268409 | A1 | 12/2005 | Blaustein et al. | |
| 2006/0032512 | A1 | 2/2006 | Kress et al. | |
| 2006/0042647 | A1* | 3/2006 | Vogel | 132/218 |
| 2006/0051155 | A1 | 3/2006 | Delage | |
| 2006/0076033 | A1 | 4/2006 | Bouix | |
| 2006/0228157 | A1* | 10/2006 | Dieudonat et al. | 401/127 |
| 2006/0272666 | A1 | 12/2006 | Wyatt et al. | |
| 2006/0272667 | A1 | 12/2006 | Wyatt et al. | |
| 2006/0272668 | A1 | 12/2006 | Wyatt et al. | |
| 2007/0186948 | A1 | 8/2007 | Kim et al. | |
| 2007/0231050 | A1 | 10/2007 | Thiebaut | |
| 2007/0261868 | A1* | 11/2007 | Gross | 173/2 |
| 2007/0272269 | A1 | 11/2007 | Wyatt et al. | |
| 2007/0289602 | A1 | 12/2007 | Simmons | |
| 2008/0011316 | A1 | 1/2008 | Malvar et al. | |
| 2008/0087296 | A1 | 4/2008 | Gueret | |
| 2008/0196735 | A1 | 8/2008 | Wyatt et al. | |
| 2008/0196736 | A1 | 8/2008 | Wyatt et al. | |
| 2008/0236607 | A1 | 10/2008 | Lee | |
| 2009/0071499 | A1 | 3/2009 | Wyatt et al. | |
| 2009/0071500 | A1 | 3/2009 | Wyatt et al. | |
| 2009/0154985 | A1 | 6/2009 | Wyatt et al. | |
| 2010/0000566 | A1 | 1/2010 | Wyatt | |
| 2010/0089414 | A1 | 4/2010 | Wyatt | |
| 2010/0269846 | A1 | 10/2010 | Wyatt | |

FOREIGN PATENT DOCUMENTS

| | | | |
|---|---|---|---|
| DE | 3833358 | C2 | 1/1996 |
| DE | 19950665 | | 5/2000 |
| DE | 20210482 | | 10/2002 |
| EP | 0289726 | E | 11/1988 |
| EP | 0371501 | A2 | 6/1990 |
| EP | 0289726 | | 8/1992 |
| EP | 0848920 | A1 | 6/1998 |
| EP | 0845305 | | 10/2002 |
| EP | 0 848 920 | B1 | 3/2003 |
| EP | 1621104 | A | 5/2006 |
| FR | 1565296 | | 4/1969 |
| FR | 2345964 | A | 10/1977 |
| FR | 2701197 | A | 3/1995 |
| FR | 200216283 | | 6/2004 |
| GB | 846639 | A | 8/1960 |
| GB | 1502532 | A | 3/1978 |
| GB | 2132884 | | 7/1984 |
| GB | 2304645 | | 3/1997 |
| GB | 2284750 | A | 10/1997 |
| JP | 61-253006 | | 11/1986 |
| JP | 04-040905 | | 2/1992 |
| JP | 5329024 | | 12/1993 |
| JP | 07-116026 | | 5/1995 |
| JP | 8289815 | | 11/1996 |
| JP | 1996289815 | A | 11/1996 |
| JP | 09-262123 | | 10/1997 |
| JP | 2005-095531 | | 4/2005 |
| JP | 2005095531 | | 4/2005 |
| KR | 20-0326065 | | 8/2003 |
| KR | 200326065 | | 8/2003 |
| KR | 2020030012684 | | 8/2003 |
| KR | 20-0334143 | | 11/2003 |
| KR | 200334143 | | 11/2003 |
| KR | 2020030025327 | | 11/2003 |
| KR | 20-0341762 | | 2/2004 |
| KR | 200341762 | | 2/2004 |
| KR | 2020030030514 | | 2/2004 |
| KR | 20-0356837 | | 7/2004 |
| KR | 200356837 | | 7/2004 |
| KR | 2020040011077 | | 7/2004 |
| KR | 20-0358513 | | 8/2004 |
| KR | 200358513 | | 8/2004 |
| KR | 2020040010980 | | 8/2004 |
| KR | 20-0393379 | | 8/2005 |
| KR | 2020050016644 | | 8/2005 |
| KR | 20-0396785 | | 9/2005 |
| KR | 2020050016643 | | 9/2005 |
| KR | 20-0404002 | | 12/2005 |
| KR | 2020050028145 | | 12/2005 |

| | | | |
|---|---|---|---|
| KR | 20-0416525 | | 5/2006 |
| KR | 20-0416536 | | 5/2006 |
| KR | 2020060004384 | | 5/2006 |
| KR | 2020060004826 | | 5/2006 |
| WO | WO 9403125 | A | 2/1994 |
| WO | WO 9700650 | A1 | 1/1997 |
| WO | WO 00/54623 | A1 | 9/2000 |
| WO | WO-2004/077987 | A1 | 9/2004 |
| WO | WO 2006130643 | A | 5/2006 |
| WO | WO 2006/090343 | A1 | 8/2006 |
| WO | WO-2006/090343 | A1 | 8/2006 |
| WO | WO 2006/130644 | A2 | 12/2006 |
| WO | WO-2006/132459 | A1 | 12/2006 |
| WO | WO 2006/132459 | A1 | 12/2006 |
| WO | WO 2007/060438 | A2 | 5/2007 |
| WO | WO 2007/094552 | A1 | 8/2007 |
| WO | WO 2008/051067 | A2 | 5/2008 |
| WO | WO 2008/102317 | A2 | 8/2008 |

OTHER PUBLICATIONS www.coolmagnetman.com.*

How are magnets made? Magnet Basics. Webpage [online] Coolmagnetman.com [retrieved on May 16, 2011]. Retrieved from the Internet: <URL: http://replay.web.archive.org/20060112024222/http://www.coolmagnetman.com/magtypes.htm>.*

U.S. Appl. No. 11/677,350, filed Feb. 21, 2007, Wyatt et al.

USPTO Office Action rejections/objections from co-pending U.S. Appl. No. 11/677,326, filed Feb. 21, 2007, Inventor: Peter Jonathan Wyatt et al , mail date Aug. 14, 2009; 6 pages.

USPTO Office Action rejections/objections from co-pending U.S. Appl. No. 11/677,350, filed Feb. 21, 2007; Inventor: Peter Jonathan Wyatt et al., mail date Jun. 18, 2009; 6 pages.

U.S. Appl. No. 11/677,350, filed Feb. 21, 2007, Peter Jonathan Wyatt, et al.

International Search Report, PCT/US2008/054525, dated Jul. 23, 2008 (6 pages).

USPTO Office Action rejections/objections from co-pending U.S. Appl. No. 11/677,326, filed Feb. 21, 2007, Inventor: Peter Jonathan Wyatt et al., mail date Mar. 11, 2010 (7 pages).

USPTO Office Action rejections/objections from co-pending U.S. Appl. No. 11/677,326, filed Feb. 21, 2007, Inventor: Peter Jonathan Wyatt et al., mail date May 18, 2010 (10 pages).

USPTO Office Action rejections/objections from co-pending U.S. Appl. No. 11/677,326, filed Feb. 21, 2007, Inventor: Peter Jonathan Wyatt et al., mail date Nov. 17, 2010 (7 pages).

USPTO Office Action rejections/objections from co-pending U.S. Appl. No. 11/677,350, filed Feb. 21, 2007; Inventor: Peter Jonathan Wyatt et al., mail date Feb. 2, 2010 (11 pages).

USPTO Office Action rejections/objections from co-pending U.S. Appl. No. 11/677,350, filed Feb. 21, 2007; Inventor: Peter Jonathan Wyatt et al., mail date Sep. 14, 2010 (9 pages).

USPTO Office Action rejections/objections from co-pending U.S. Appl. No. 11/677,350, filed Feb. 21, 2007; Inventor: Peter Jonathan Wyatt et al., mail date Nov. 29, 2010 (3 pages).

USPTO Office Action rejections/objections from co-pending U.S. Appl. No. 11/677,350, filed Feb. 21, 2007; Inventor: Peter Jonathan Wyatt et al., mail date Jan. 4, 2011 (8 pages).

USPTO Office Action rejections/objections from co-pending U.S. Appl. No. 11/677,350, filed Feb. 21, 2007; Inventor: Peter Jonathan Wyatt et al., mail date Apr. 4, 2011 (3 pages).

USPTO Office Action rejections/objections from co-pending U.S. Appl. No. 11/677,350, filed Feb. 21, 2007; Inventor: Peter Jonathan Wyatt et al., mail date Oct. 21, 2011 (9 pages).

USPTO Office Action rejections/objections from co-pending U.S. Appl. No. 11/677,350, filed Feb. 21, 2007; Inventor: Peter Jonathan Wyatt et al., mail date Jun. 1, 2012 (2 pages).

* cited by examiner

COSMETIC APPLICATOR WITH TORQUE LIMITER

FIELD OF THE INVENTION

The present disclosure is directed to a cosmetic applicator with a torque limiter, and in particular to an applicator having an applicator head with a rotational motion component for use in applying cosmetic material, such as mascara, to keratinous fibers, such as eyelashes, and a torque limiter for use with such an applicator.

BACKGROUND OF THE INVENTION

Various types of cosmetic applicators are known in the art. Brushes or wands for applying mascara to eyelashes, for example, generally include an applicator head with a stem having a first end attached to a handle. The applicator head also includes one or more applicator elements coupled to a second end of the stem. In use, the applicator elements are loaded with mascara and applied to the eyelashes.

Conventional mascara brushes typically require manipulation of the handle or other member, and often require repeated passes of the brush across the eyelash, to completely and uniformly coat each eyelash with mascara while maintaining or promoting separation of the eyelashes from one another. To coat the entire eyelash, for example, a user may move the brush in a vertical direction to ensure that the entire eyelash is covered. In addition, a user may rotate the brush to place different portions of the brush head in contact with the eyelash, depending on the desired amount of mascara to be applied to the eyelashes. Still further, a user may also reciprocate the brush in a horizontal direction to promote separation of the eyelashes and/or to ensure better coverage of the eyelashes. Consequently, a user must provide the motive force for applying the brush to the eyelashes and must have sufficient dexterity to manipulate the brush as needed to cover the eyelashes in a satisfactory manner. In addition, mascara application with conventional brushes requires several brush passes and therefore is inefficient.

More recently, rotating mascara brushes have been proposed in which a stem of the brush is supported for rotational motion relative to the handle. The force for rotating the stem and attached brush head may be either manual, such as for the brushes described in U.S. Pat. No. 6,145,514 to Clay and U.S. Pat. No. 5,937,871 to Clay, or may be electrically driven, such as the brush described in U.S. Pat. No. 4,056,111 to Mantelet. Such brushes assist the user by automating, at least to some degree, the process of application of the mascara to the eyelash, and thereby address some of the difficulties and inefficiencies experienced with brushes where the applicator head is fixed to the handle.

It will be recognized that it is possible, under certain circumstances, for eyelashes to become bound to the applicator head or become enmeshed with the applicator elements during application of mascara. For example, as an applicator head is rotated, the eyelashes may become coupled to the applicator elements, and may begin to wrap about the applicator head. As the rotational motion of the applicator head continues, the applicator may begin to pull or tug on the eyelashes, and even on the eyelid. Automation may increase the speed at which this effect occurs, and thereby decrease the time window for the user to take corrective action.

Accordingly, it may be desirable to provide a system or an article that limits the amount of force applied to eyelashes that are in contact with a rotating element of the system or article. It may also be desirable to provide a system or an article that automatically limits uncontrolled binding or enmeshment of the applicator elements and the eyelash (i.e., without user intervention). It may also be desirable to provide a system or an article that facilitates the efforts of the user while overcoming one or more of the drawbacks of conventional technology.

SUMMARY OF THE INVENTION

A cosmetic applicator includes a handle, a drive coupled to the handle, an applicator head coupled to the drive, and a torque limiter. The torque limiter includes a magnetic coupling, the magnetic coupling being coupled to at least one of the drive and the applicator head such that the torque applied via the applicator head does not exceed a predetermined allowable torque.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

The present disclosure details a variety of torque limiters for use with a cosmetic applicator having applicator elements that at least in certain states are moveable with at least a rotational motion component. While various embodiments of torque limiters are discussed with reference to FIGS. 1-27, additional disclosure is provided with reference to FIGS. 28-51 regarding the various components of the applicator (e.g., the applicator head, the drive, etc.) so as to illustrate, in part, the potential range of applicators that may be used with the torque limiters according to the present disclosure.

DEFINITIONS

The term "cosmetic applicator" or "applicator" refers to an apparatus, device or system used to apply cosmetic material, such as mascara, to a keratinous material, such as eyelashes.

The term "applicator element" refers to a structure from which a cosmetic material, such as mascara, is transferred to a keratinous material, such as eyelashes.

The term "applicator head" refers to one or more applicator elements and a structure that supports the applicator element (s). According to certain embodiments, the applicator head may include protrusions and a core from which the protrusions extend or depend.

The term "attached" refers to elements being connected or united by adhering, fastening, bonding, etc. by any method suitable for the elements being joined together. Many suitable methods for attaching elements together are well-known, including adhesive bonding, mechanical fastening, etc. Such attachment methods may be used to attach elements together over a particular area either continuously or intermittently.

The term "coupled" refers to configurations whereby an element is directly secured to another element by attaching the element directly to the other element, and to configurations whereby an element is indirectly secured to another element by attaching the element to intermediate member(s) that is(are) in turn attached to the other element.

The term "disposed" is used to mean that an element(s) is exists in a particular place or position as a unitary structure with other elements or as a separate element coupled to other elements.

The term "drive" refers to an apparatus, device or system that moves a driven element, such as an applicator head or applicator element, that is coupled to the drive. The drive may include a motor, a transmission and a source of power for the motor.

The term "protrusion" refers to a member that extends or depends generally away from or into a base surface, such as of an applicator head. As such, a protrusion provides a localized area that is not continuous with the surrounding base surface.

Applicator with Torque Limiter

Figure 1:
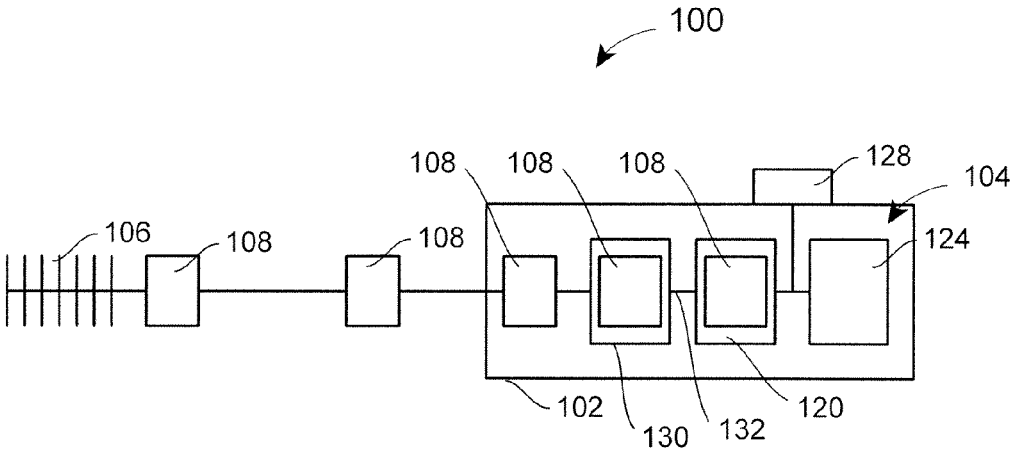
FIG. 1 is a schematic of a cosmetic applicator marked with several alternative placements for a torque limiter according to the present disclosure.

As seen in FIG. 1, a cosmetic applicator 100 according to the present disclosure includes a handle 102, a drive 104 disposed on or in the handle 102, and an applicator head 106 coupled to the drive 104. The applicator 100 also includes, according to the present disclosure, a torque limiter 108 that limits the torque applied via the applicator head 106, in whole or in part and at least in certain states, such that the torque does not exceed a predetermined allowable torque.

In all or only in certain operative states, the drive 104 may move the applicator head 106 (in whole or in part) at rotational speeds suitable for applying mascara to keratinous fibers. That is, in certain operative states, the drive 104 may be disengaged and/or decoupled from the applicator head 106 such that the applicator head 106 has no or limited rotational motion (or no or limited motion) relative to the handle 102, while in other states the drive 104 may be engaged and/or coupled to the head 106 to move the head 106 with a rotational motion component relative to the handle 102. Alternatively, the drive 104 and/or the head 106 may be secured against at least rotation motion in certain operative states. In regard to such alternative embodiments, the drive 104 or head 106 may be engaged, in whole or in part, by an element, such as a switch, that couples the drive or the head 106 fixedly to the handle 102, such that no or only limited relative rotational motion (or no or limited motion) may occur between the head 106 and the handle 102.

As to the operational speeds possible for the head 106, a speed of approximately 1 to 200 rpm may be used. According to certain embodiments, a speed of approximately 5 to 100 rpm may be used. In fact, according to particular embodiments, speeds within the range of approximately 10 to 60 rpm may be used. The speed may be fixed, or may be adjustable within the appropriate range, as explained in greater detail below.

The drive 104 may include a motor or actuator 120. The motor 120 may be mechanical motor with a source of potential mechanical energy in the form of a resilient member—a spring or rubber band, for example. Alternatively, the motor 120 may be an electric motor, in which case the drive 104 may also include a power source 124 (such as a battery, for example) coupled to the motor 120 to provide the necessary voltage and current. Where the motor 120 is an electric motor, the voltage and current may even be provided by an power source external to the handle 102, such as an embodiment wherein to the motor 120 is coupled to the electric mains via an electrical outlet, for example. According to certain embodiments, a drive circuit may be coupled to the motor 120 and the source 124 to control operation of the motor 120. The drive circuit may include a switch 128 to turn the motor 120 on and off, or couple and decouple the motor 120 to the source 124.

The drive 104 may also include a transmission 130 that is coupled to a shaft 132 of the motor 120. The transmission 130 may transform, in whole or in part, the motion of the motor 120 (or, more particularly, the motor shaft 132) prior to coupling to the applicator head 106. For example, linear motion of the motor 120 may be transformed, at least in part, to rotational motion. In addition or in the alternative, the transmission 130 may reduce the speed of the motor 120 to a rotational speed appropriate for the applicator head 106. In certain embodiments, the transmission 130 may not be required because the motor shaft 132 does not rotate faster than the desired rotational speed of the applicator head 106. In other embodiments, the transmission 130 may not be required because the motor 120 is capable of providing variable motions or speeds.

FIG. 1 illustrates several different locations where the torque limiter 108 may be disposed or coupled. In general terms, the torque limiter 108 may be coupled between the drive 104 and the applicator head 106 or may be disposed within the drive 104. In particular, the torque limiter 108 may be coupled at various points between the head 106 and the drive 104, and in particular between the head 106 and a transmission 130. Alternatively, the torque limiter 108 may be coupled to or disposed within the motor 120 or the transmission 130. It should also be noted that the limiter 108 may include subassemblies, each of the subassemblies associated with different elements of the applicator 100 (the head 106 and the drive 104, for example) and the limiter 108 formed only after the elements are assembled to form the applicator 100. FIG. 1 is not intended to be exhaustive of the potential variations in placement or assembly, but merely illustrative of the positions and assembly options possible.

It will be recognized that the torque limiter 108 has a predetermined torque at which it is triggered, decoupling the head 106 from the drive 104, for example. The predetermined torque for the limiter 108 in such embodiments may represent a maximum allowable torque at which the applicator head 106 will remain coupled to the drive 104. It is presently believed that the predetermined torque should be no greater than approximately 5 oz-in. Accordingly, the predetermined torque (maximum allowable torque) may be approximately 2 oz-in, approximately 1.5 oz-in or even approximately 0.5 oz-in. On the other hand, it is presently also believed that the predetermined torque should not be less than approximately 0.1 oz-in, or in any event not less than approximately 0.05 oz-in. Thus, one acceptable range of predetermined torques (maximum allowable torques) may be between approximately 0.1 oz-in and approximately 1.5 oz-in. Alternatively, an acceptable range of allowable torques may be between approximately 0.1 oz-in and approximately 0.5 oz-in.

Upon reaching the predetermined torque, the response of the torque limiter according to the present disclosure may vary among the embodiments disclosed. According to certain embodiments, a certain level of torque may be permitted, which torque may assist in signaling to the user that a condition exists that needs to be resolved. For example, the torque limiter may be in the form a weak torque motor that simply stalls when a certain torque is achieved. According to alternative embodiments, when the predetermined torque is exceeded, the torque limiter operates to decouple the head 106 from the drive 102, or to deactivate the drive 102, or a combination thereof. Thus, a torque limiter seeks to limit the torque, but does not necessarily decouple or deactivate the drive.

Figure 20:
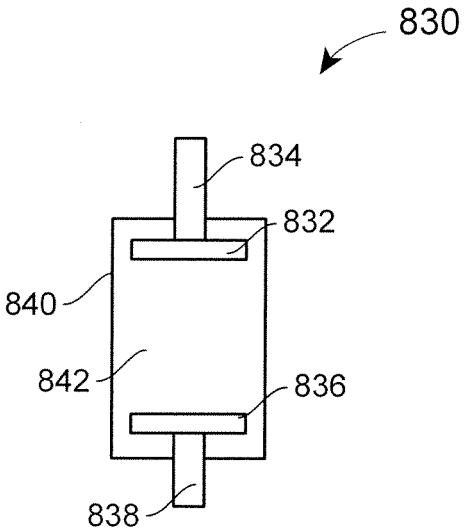
FIG. 20 is a schematic of a torque limiter in the form of a fluidic or viscous coupling.
Figure 21:
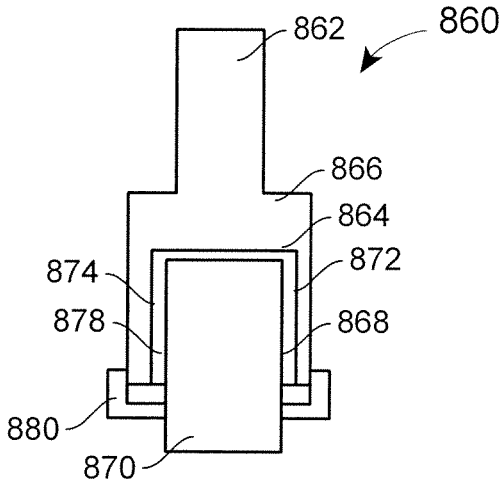
FIG. 21 is a schematic of a torque limiter in the form of a fluidic or viscous coupling.
Figure 26:
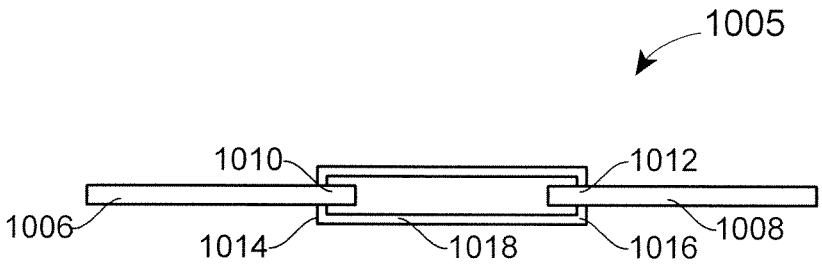
FIG. 26 is a schematic of a fifth alternative torque limiter.
Figure 27:
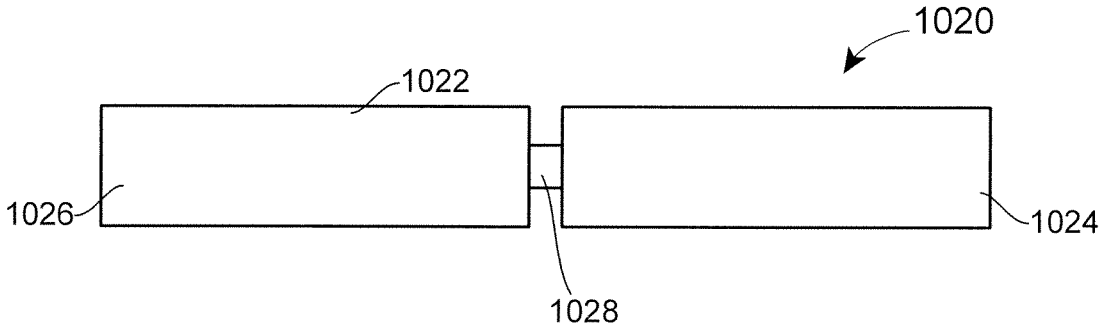
FIG. 27 is a schematic of a sixth alternative torque limiter.

The torque limiter 108 may take any of a number of different forms. For example, the torque limiter 108 may include a slip coupling (FIGS. 2-13). According to other embodiments, the torque limiter 108 may include a magnetic coupling (FIGS. 14-18). According to still other embodiments, the torque limiter 108 may include a fluidic or viscous coupling (FIGS. 19-21). Further, the torque limiter 108 may include different mechanisms for decoupling the motor 120 from the power source 124 (FIGS. 22, 23 and 25), or decoupling the transmission 130 (FIG. 24). Alternatively, a mechanism for absorbing the torque may be used (FIGS. 26 and 27).

It will be recognized that a torque limiter 108 that includes combinations of structures from each of these groups may be possible (e.g., a torque limiter 108 that includes a slip coupling and a magnetic coupling). It will also be recognized that additional embodiments of torque limiters may exist. However, it would be impractical, if not impossible, to recite every combination and every embodiment. Consequently, the following exemplary combinations and embodiments are discussed below.

Slip Coupling as Torque Limiter

FIGS. 2-13 illustrate a variety of torque limiters 108 in the form of slip couplings. In general terms, a slip coupling may include at least a pair of opposing surfaces coupled to each other through a frictional connection.

The frictional connection will be determined, at least in part, according to the static and kinetic coefficients of friction of the materials used for the coupling. According to certain embodiments, the static and kinetic coefficients of friction for the materials used in the slip coupling may be substantially equal (a ratio of one or nearly one). According to other embodiments, however, the coefficients may not be substantially equal. For example, materials having a higher static coefficient of friction that kinetic coefficient of friction may be used such that torque is transmitted past the coupling only after the relative motion between the opposing surfaces stops.

The coefficients of friction for a material on one side of the frictional connection may be varied by applying a coating to one or more of the opposing surfaces. For example, a material such a TEFLON may be used to vary the coefficients of friction. It will be recognized that other alternative materials could be used.

The coefficients of friction may also be varied by altering the surface characteristics of one or more of the opposing surfaces through texturing. The surfaces may be smooth or substantially smooth. Alternatively, the surfaces may be rough or substantially rough.

Figure 2:
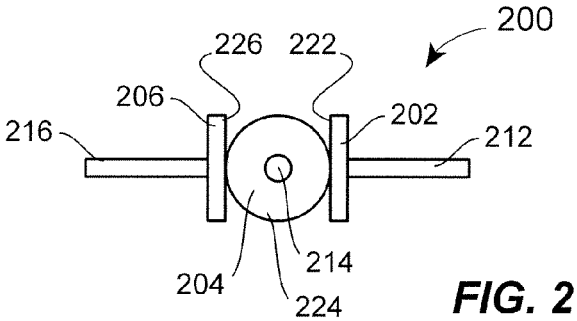
FIG. 2 is a schematic of a torque limiter in the form of a slip coupling.

FIG. 2 illustrates a first slip coupling 200 according to the present disclosure. The slip coupling 200 may include three wheels 202, 204, 206, each wheel 202, 204, 206 mounted on a respective shaft 212, 214, 216. It will be recognized relative to this and other embodiments, gears may be used in place of wheels. As illustrated, the shafts 212, 216 lie in the plane of the page, while the shaft 214 is at an angle (e.g., orthogonal) to the plane of the page. The shaft 212 may be coupled to the drive 104, while the shaft 216 may be coupled to the applicator head 106. Each of the wheels 202, 204, 206 has a rim 222, 224, 226, each of the rims defining one of a pair of opposing surfaces in frictional connection. In particular, rims 222, 224 may define one pair, while rims 224, 226 may define a second pair. When the torque on the shaft 216 exceeds a predetermined value, the rims 222, 224 and 224, 226 may slip relative to each other, and in this fashion limit the torque at the applicator head 106.

Figure 3:
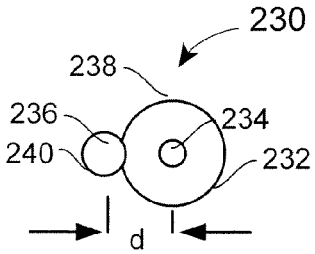
FIG. 3 is a schematic of a torque limiter in the form of a slip coupling.

FIG. 3 illustrates a second slip coupling 230 according to the present disclosure. The slip coupling 230 may include at least one wheel 232 and two shafts 234, 236. The wheel 232 is mounted on the shaft 234, which may be coupled to the drive 104. The wheel 232 also has a rim surface 238 that abuts an outer surface 240 of the shaft 236, which may be coupled to the applicator head 106. The wheel 232 may be made of a material that is deformable, such that when the distance "d" between the shafts 234, 236 is selected, the surface 238 is deformed about the shaft 236. The surfaces 238, 240 thus may define the pair of opposing surfaces in frictional connection. Alternatively, instead of having the surface 238 abut the surface 240 of the shaft 236, a wheel may be secured to the shaft 236 with its rim surface abutting the surface 238 of the wheel 232.

Figure 4:
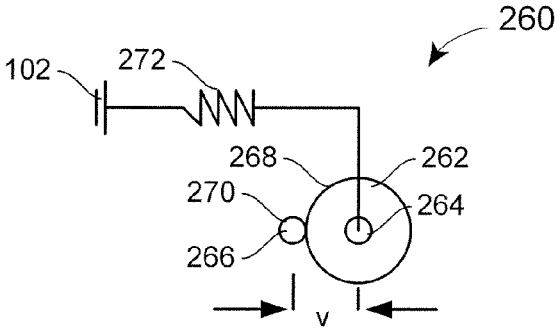
FIG. 4 is a schematic of a torque limiter in the form of a slip coupling.

FIG. 4 illustrates a third slip coupling 260 according to the present disclosure. The slip coupling 260, similar to the slip coupling 230, may include at least one wheel 262 and two shafts 264, 266. The wheel 262 is mounted on the shaft 264, which may be coupled to the drive 104. The wheel 262 has a rim surface 268 that abuts an outer surface 270 of the shaft 266, which may be coupled to the applicator head 106. Unlike the slip coupling 230, the wheel 262 is not deformable. Instead, the distance "v" between the shafts 264, 266 may vary. Furthermore, a resilient member 272 is coupled between the shaft 264 and ground (the inner surface of the handle 102, for example). The resilient member 272 may be a spring, for example, and may bias the surface 268 against the surface 270. As one alternative, instead of having the surface 268 abut the surface 270 of the shaft 266, a wheel may be secured to the shaft 266 with its rim surface abutting the surface 268 of the wheel 262.

Figure 5:
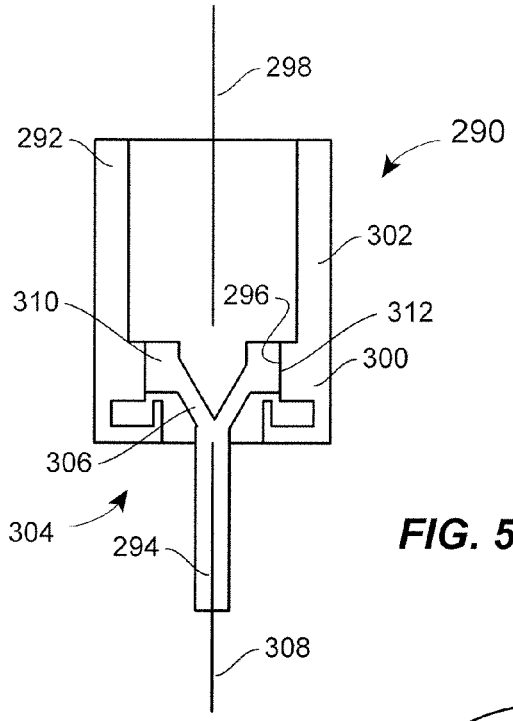
FIG. 5 is a schematic of a torque limiter in the form of a slip coupling.

FIG. 5 illustrates a fourth slip coupling 290. The slip coupling 290 includes a hollow outer shaft 292 and an inner shaft 294. The outer shaft 290 may be coupled to the drive 104, while the inner shaft 294 may be coupled to the applicator head 106. The outer shaft 292 has an inwardly-facing surface 296 that may be disposed at a radial distance from a central axis 298 of the shaft 292. In fact, as illustrated, the surface 296 may be defined on an inwardly-depending step 300 that depends from a wall 302 of the shaft 292. The inner shaft 294 has a forked end 304, with legs 306 that are disposed at an angle to a central axis 308 of the shaft 294. At the end of each leg 306 is a shoe 310 with a surface 312 that abuts the surface 296, thereby defining a pair of opposing surfaces. At least the forked end 304 of the shaft 294 is formed of a resilient material, such that the shoes 310 are biased into engagement with the step 300. According to at least one embodiment, the angle of the leg 306 relative to the central axis 308 is greater when the shoe 310 is not engaging the step 300, and the reduction in the angle when the shaft 294 is disposed such that the shoe is engaging the step 300 creates a biasing force that urges the shoes 310 into engagement with the step 300.

Figure 6A:
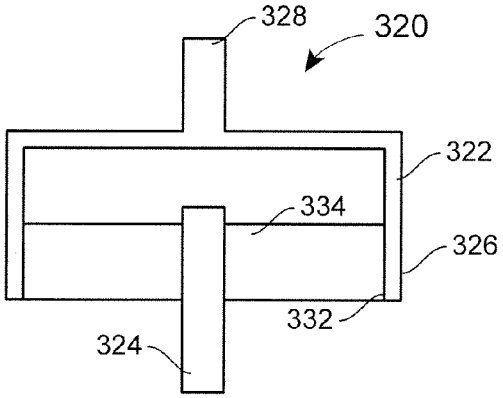
FIGS. 6A and 6B are schematics of a torque limiter in the form of a slip coupling.
Figure 6B:
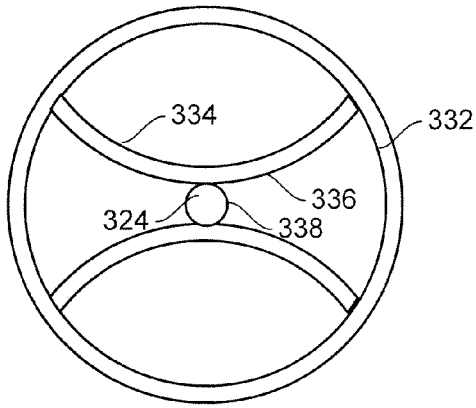

FIGS. 6A and 6B illustrated a fifth slip coupling 320. Similar to the embodiment in FIG. 5, the embodiment of FIGS. 6A-B has an outer hollow shaft 322 and an inner shaft 324. As will be recognized from FIG. 6A, the entire shaft 322 need not be hollow or tubular; only a section 326 need be tubular, the remainder 328 having a narrower diameter and solid cross-section. Attached to a surface 330 of the shaft 332 is a pair of resilient members 334, similar in shape to leaf springs. The springs 334 each have a surface 336 that abuts a surface 338 of the shaft 324 therebetween, as best seen in FIG. 6B. The surfaces 336, 338 define a pair of opposing surfaces in frictional connection.

Figure 7:
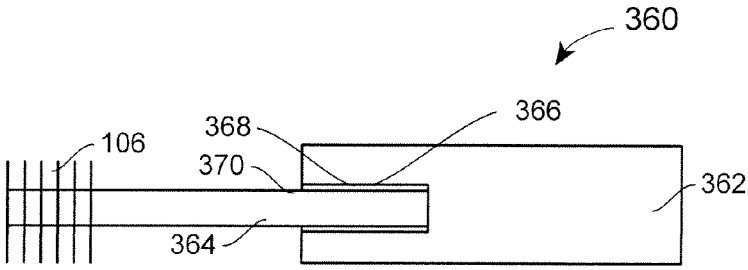
FIG. 7 is a schematic of a torque limiter in the form of a slip coupling.

FIG. 7 illustrates a sixth slip coupling 360. This coupling 360 shares features in common with the fourth and fifth embodiments, in that there is an outer hollow shaft 362 and an inner shaft 364. According to this embodiment, the inner shaft 364 may be coupled to the applicator head 106, as shown, while the outer shaft 362 may be coupled to the drive 104. The outer shaft 362 has a receptacle 366 formed therein, the receptacle 366 having a surface 368. The inner shaft 364 has an outer surface 370 that abuts the surface 368 with the shaft 364 disposed in the receptacle 366. The relative motion between the surfaces 368, 370 is controlled according to the coefficients of friction, such that the surfaces 368, 370 defined the pair of opposing surfaces in frictional connection.

Figure 8:
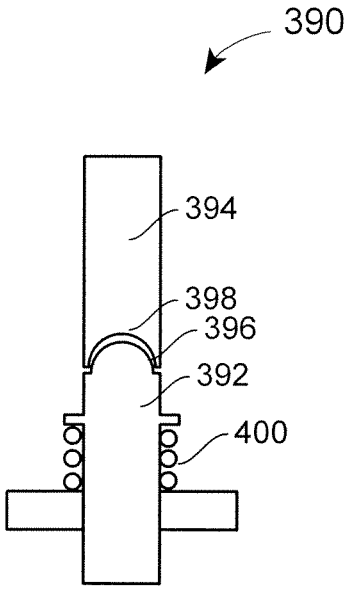
FIG. 8 is a schematic of a torque limiter in the form of a slip coupling.

FIG. 8 illustrates a seventh slip coupling 390. The coupling 390 includes first and second shafts 392, 394. Each shaft 392, 394 include one of a pair of mating surfaces 396, 398, the surfaces being non-planar. In fact, as illustrated, the first mating surface 396 is convex, at least along a section of the surface, while the second mating surface 398 is concave and complementary-shaped to the first mating surface 396. Additionally, the coupling 390 includes a resilient element or member 400, such as a spring, that biases the two shafts 392, 394 towards each other, and thus that biases the two surfaces 396, 398 towards each other. In a first state, the first and second surfaces 396, 398 mate one inside the other. However, when a predetermined level of torque is experienced at the applicator head 106, the surfaces 396, 398 may move relative to each other, in fact causing the shaft 392 to move in an axial direction against the biasing of the resilient member 400.

Figure 9:
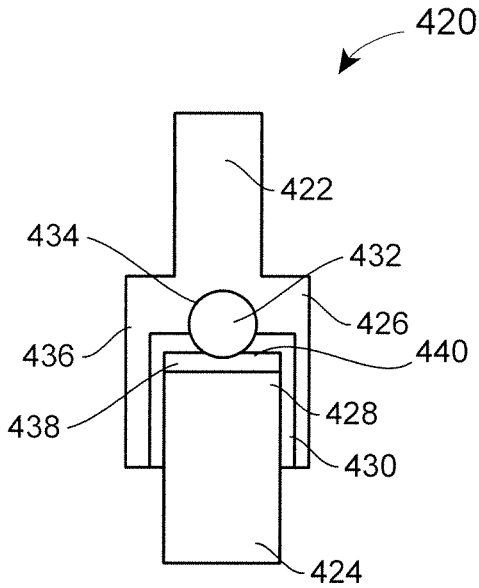
FIG. 9 is a schematic of a torque limiter in the form of a slip coupling.

FIG. 9 illustrates an eighth slip coupling 420. The coupling 420 includes first and second shafts 422, 424. Similar to certain preceding embodiments, the first shaft 422 has a section 426 that is hollow, while the shaft 424 does not. Thus, an end 428 of the shaft 424 is received within a receptacle 430 formed in the hollow section 426 of the shaft 422. The first shaft 422 also has an object 432 with a circular or oval cross-section and a surface 434 disposed and retained at an end 436 of the receptacle 430. According to at least one embodiment, the object 432 may be a ball bearing. Opposite the ball bearing 432 may be a layer 438 of material having a surface 440 attached to the end 428 of the shaft 424. The layer 438 may be non-deformable or, alternatively, may allow for a certain degree of deformation. Accordingly, by varying the force applied to either or both of the shafts 422, 424, the roundness of the object 432, and the degree of deformation of the layer 436, the size of the surface area in contact between the opposing surfaces 434, 440 may be controlled.

Figure 10:
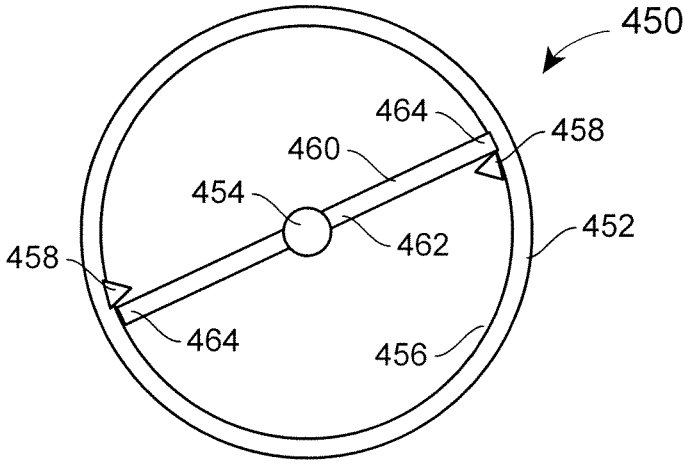
FIG. 10 is a schematic of a torque limiter in the form of a slip coupling.

FIG. 10 illustrates a ninth slip coupling 450. The coupling includes an outer hollow shaft 452 and an inner shaft 454. The hollow shaft 452 has a surface 456. According to the embodiment illustrated, the surface 456 has a pair of stiff detents 458 disposed on the surface 456. On the other hand, a flexible arm 460 is coupled at one point 462 to the shaft 454, with ends 464 cantilevered therefrom. As illustrated, the ends 464 and detents 458 may abut in at least a first state, while in a second state the ends 464 may move past the detents 458, at least for a half-revolution of relative motion between the shafts 452, 454 according to the torque applied to the shaft 454, for example. After the half-revolution, depending on the torque applied, the ends 464 may again move past the detents 458, or the relative motion between the shafts 452, 454 may stop.

A considerable number of alternative embodiments may exist to the coupling 450. For example, it will be recognized that the detents 458 could be resilient, and the arm 460 stiff. Also, a greater or lesser number of detents 458 may be included, which may cause the relative motion to stop once per revolution or every quarter revolution, for example. Further, the detents 458 may be formed separately from the shaft 452 and attached to the surface 456, or formed integrally with the shaft 452 and surface 456. Additionally, rather than having an arm 460 with ends 464 that may cooperate with detents 458, the arm 460 may have a single, cantilevered end 464.

Figure 11A:
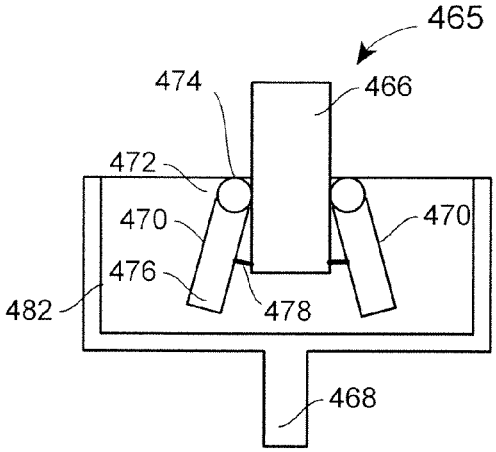
FIGS. 11A and 11B are schematics of a torque limiter in the form of a slip coupling.
Figure 11B:
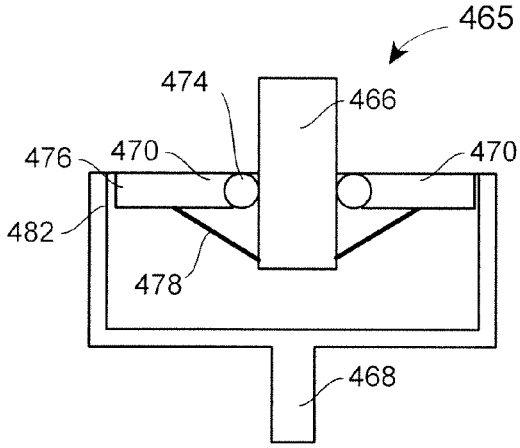

FIGS. 11A and 11B illustrate a tenth embodiment of slip coupling 465 including a first shaft 466, which may be coupled to the drive 102, and a second, hollow shaft 468, which may be coupled to the head 106. The first shaft 466 has coupled to it one or more legs 470. As illustrated, the legs 470 are coupled at a first end 472 by a hinge 474 to the first shaft 466, and have a second, free end 476. The legs 470 are biased using resilient members 478 (such as springs, for example) toward a first state, wherein the legs 470 are substantially parallel to the first shaft 466. However, as the first shaft 466 rotates, the legs 470 may move outward against the biasing force applied by the resilient members 478 to assume a second state, wherein the legs 470 are at an angle relative to the shaft 466. As illustrated in FIG. 11B, the legs 470 may be substantially at right angles to shaft 466 in the second state.

With the legs 470 in the second state, the free ends 476 of the legs 466 may abut an inner surface 482 of the shaft 468. In this fashion, a frictional connection may be formed between the free ends 476 of the legs 466 and the inner surface 482, the ends 476 and the surface 482 defining a pair of opposing surfaces. As noted relative to the other embodiments discussed in this section, when a predetermined torque is achieved at the head 106, the ends 476 and surface 482 slip past each other to limit the torque transmitted.

Figure 12:
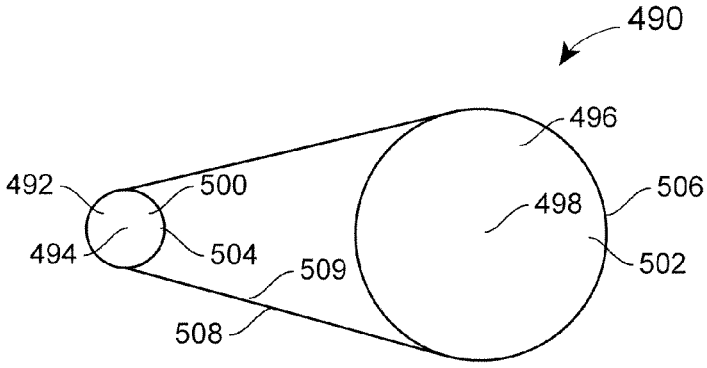
FIG. 12 is a schematic of a torque limiter in the form of a slip coupling.
Figure 13:
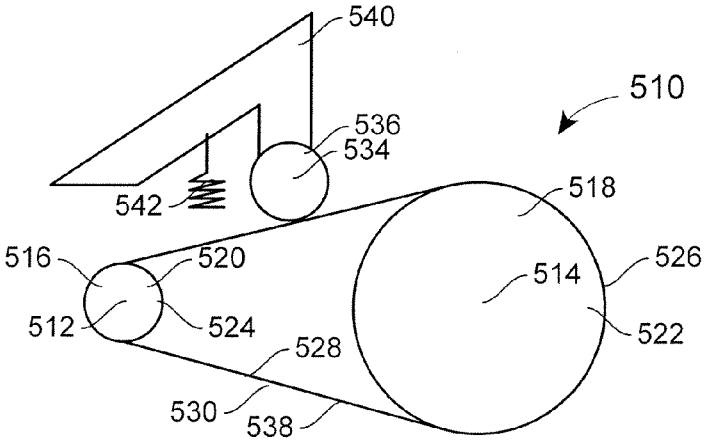
FIG. 13 is a schematic of a torque limiter in the form of a slip coupling.

FIGS. 12 and 13 illustrate a eleventh and twelfth form of slip coupling 490, 510. Both of these slip couplings 490, 510 rely on relative motion of wheels and belts.

The coupling 490 includes a first wheel 492 coupled to a first shaft 494, and a second wheel 496 coupled to a second shaft 498. Each of the wheels 492, 496 has a rim 500, 502 with a surface 504, 506. The surfaces 504, 506 may be smooth, or the surfaces 504, 506 may be knurled or otherwise textured. A belt 508 is fitted about the wheels 492, 496, and in particular the rims 500, 502, such that a surface 509 of the belt abuts and cooperates with the surfaces 504, 506 of the wheels 492, 496. The surfaces 504, 506 and the surface 509 may be complementary to each other, according to certain embodiments where the surfaces 504, 506 have a groove formed therein and the belt has a cross-section that is complementary to that groove. The tension may be maintained on the belt 509 by maintaining a particular distance between the shafts 494, 498, which distance may be fixed or adjustable (for example, through the use of a resilient member to bias the shafts 494, 498 apart).

The coupling 510 also includes shafts 512, 514 coupled to wheels 516, 518. The wheels have rims 520, 522 with surfaces 524, 526 that are in frictional connection with a surface 528 of a belt 530. An idler wheel 534 may have a surface 536 in contact with the opposite surface 538 of the belt 530. The idler wheel 534 may be coupled to an arm 540 and biased such that the surface 536 abuts the surface 538 through the function of the resilient member 542. The idler wheel 534 may thus be used to control the tension on the belt 530.

While it will be recognized that still other embodiments are possible for the slip coupling, these embodiments are included as exemplary forms of this coupling.

Magnetic Coupling as Torque Limiter

FIGS. 14-18 illustrate a variety of torque limiters 108 in the form of magnetic couplings. In general terms, the shafts coupled to the drive 104 and applicator head 106 are coupled together, at least in part, by the magnetic force between two objects—such as between two magnets, or between a magnet and a material having a medium or higher magnetic permeability, such as iron. When a certain torque is realized at the applicator head 106, for example, through one or more lashes becoming bound or enmeshed in the applicator head 106, the magnetic coupling decouples, in whole or in part, to limit the torque applied to the lashes. As will be noted below, the magnetic coupling may be combined with a slip coupling.

At the outset, it should be noted that the magnet or magnets used in the embodiments of magnetic coupling described herein may be of that variety that is commonly termed "permanent" magnets, although the strength of the magnet may vary with time. Alternatively, the magnet may be an electromagnet, where the magnetic field is generated by running current through a wire, for example. Such an electromagnet may be used, for example, where a battery is provided to power the drive 104 of the applicator 100. One or both of the magnets may be permanent magnet or electromagnets.

Figure 14:
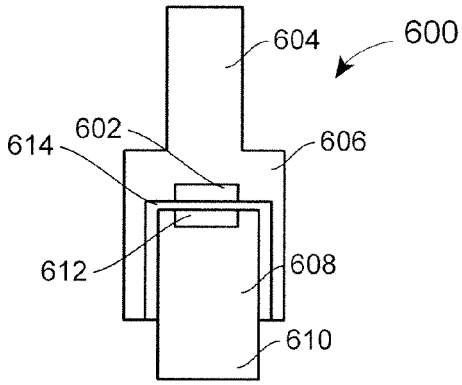
FIG. 14 is a schematic of a torque limiter in the form of a magnetic coupling.

A first embodiment of magnetic coupling 600 is illustrated in FIG. 14. According to this embodiment, a first magnet 602 may be coupled to a first shaft 604, which in turn may be coupled to the drive 104. The shaft 604 may have a receptacle 606 formed therein to accept an end 608 of a second shaft 610, which in turn may be coupled to the applicator head. A second magnet 612 (or a material having a medium to high magnetic permeability) may be coupled to the end 608 of the second shaft 614. The first and second shafts 604, 610 may be supported in such a fashion that a gap 616 is maintained between the two magnets 602, 612. The magnets 602, 612 are aligned with the axes of the respective shafts 604, 610. According to such an embodiment, the coupling formed is primarily (if not exclusively) magnetic.

Figure 15A:
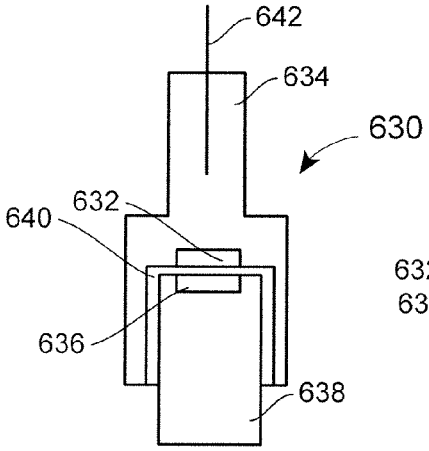
FIGS. 15A and 15B are a schematic of a torque limiter in the form of a magnetic coupling.
Figure 15B:
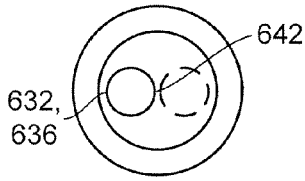

FIGS. 15A and 15B illustrate a second embodiment of a magnetic coupling 630, which is similar to the first coupling 600 in several regards, the differences best view relative to FIG. 14B. According to this embodiment, a first magnet 632 is coupled to a first shaft 634, and a second magnet 636 is coupled to a second shaft 638. Additionally, a gap 640 is maintained between opposing surfaces of the first and second magnets 632, 636. However, unlike the coupling 600, the first and second magnets 632, 636 are not aligned along an axis 642 of shafts 634, 638. Instead, as best seen in FIG. 14A, in a first, coupled state, the magnets 632, 636 are aligned at an offset position relative to the common axis 642. As a consequence, when a sufficient relative torque is applied to decouple the magnetic coupling 630, the magnets 632, 638 are spaced from each other (see dashed lines, for example) along axes that are parallel to each other.

Figure 16:
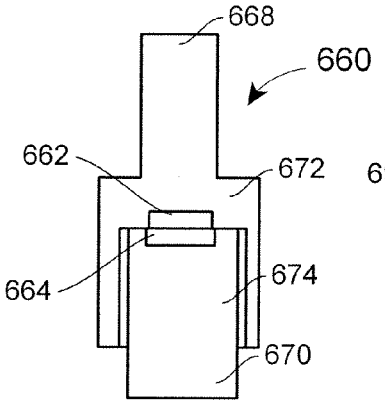
FIG. 16 is a schematic of a torque limiter in the form of a magnetic and slip coupling.

FIG. 16 is a third embodiment of a magnetic coupling 660, which is similar to the embodiment of FIG. 14 in that it has first and second magnets 662, 664 coupled to separate shafts 668, 670, thereby defining a magnetic coupling. However, according to this embodiment, a force is applied to one or both of the shafts 668, 670 to bias the ends 672, 674 of the shafts 668, 670 towards each other to abut one with the other, thereby removing any gap therebetween. With the ends 672, 674 in contact, a frictional connection is defined, as well as the magnetic coupling 660. This embodiment thus represents one possible combination of slip and magnetic couplings.

Figure 17:
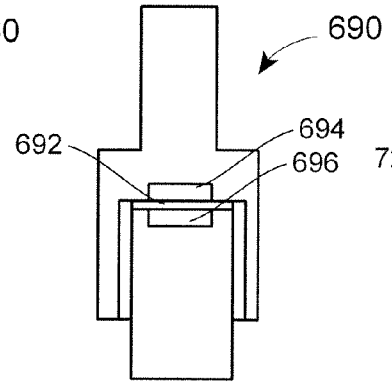
FIG. 17 is a schematic of an alternative embodiment to the magnetic and slip coupling of FIG. 16.
Figure 18:
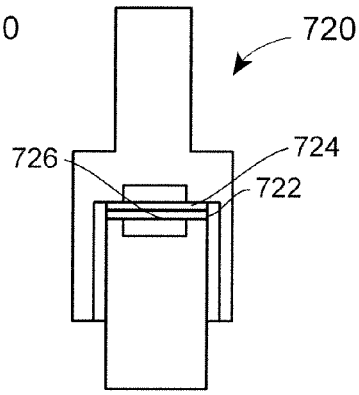
FIG. 18 is a schematic of an alternative embodiment to the magnetic and slip coupling of FIG. 16.

FIGS. 17 and 18 represent variations on the structure of FIG. 16. According to coupling 690 of FIG. 17, at least one of the opposing surfaces may include a coating 692 applied thereto to alter at least one of a static coefficient of friction or a kinetic coefficient of friction. According to coupling 720 of FIG. 18, a spacer 722 is disposed between the ends 724, 726, the spacer 722 comprising first and second layers 728, 730 that may move relative to each other, the layers 728, 730 having opposing surfaces frictional connected to each other. It should also be noted that the area in contact for frictional connection may specifically be controlled in a fashion such as illustrated in FIG. 9 above.

While it will be recognized that still other embodiments are possible for the magnetic coupling, these embodiments are included as exemplary forms of this coupling.

Fluidic or Viscous Coupling as Torque Limiter

FIGS. 19-21 illustrate a variety of torque limiters 108 in the form of fluidic or viscous couplings. In general terms, the first and second shafts, which may be coupled to the drive and applicator head, for example, may be coupled through the use of a gaseous, liquid, semi-solid or even solid substance that has fluid or fluid-like characteristics.

A variety of materials may be used in the fluidic or viscous coupling according to the present disclosure. As noted above, gases, such as air, or liquids, such as water or oil, may be used. Alternatively, a semi-solid material, such as a gel, may be used. Moreover, a solid material may be dispersed in a liquid and used in embodiments of the present disclosure. For that matter, a solid material may exhibit fluid-like characteristics, so as to be useful in a fluidic or viscous coupling according to the present disclosure. For example, it is believed that microbeads of a solid material may exhibit sufficient fluid-like characteristics so as to be useful in the fluidic or viscous couplings according to the present disclosure. As one example, ceramic beads may be used where the mass of the bead does not greatly contribute to the interbead effects.

According to certain embodiments, a finned device, such as a propeller, impeller, or pump, may be used in the coupling. According to other embodiments, the viscous substance alone provides the coupling between the shafts.

Figure 19A:
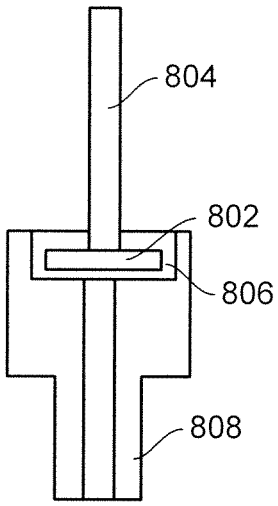
FIGS. 19A and 19B are a schematic of a torque limiter in the form of a fluidic or viscous coupling.
Figure 19B:
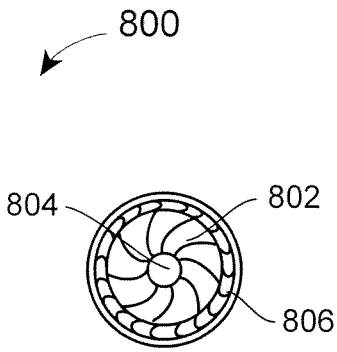

FIGS. 19A and 19B illustrate a first embodiment of a viscous coupling 800. The coupling 800 includes a first finned device 802 coupled to a first shaft 804 and a second finned device 806 coupled to a second shaft 808. The first shaft 804 may be coupled to the drive 104, while the second shaft may be coupled to the applicator head 106. According to this embodiment, the finned device 802 draws in air from outside the drive, which air enters the second finned device 906, causing the second finned device 806 to turn shaft 808.

FIG. 20 illustrates a second embodiment of a viscous coupling 830. Like the coupling 800, the coupling 830 includes a first finned device 832 coupled to a first 834, and a second finned device 836 coupled to a second shaft 838. However, unlike the coupling 800, which drew its working fluid (air) from the surrounding environment, the first and second finned devices 832, 836 depend through ends of a housing or tank 840 that contains the working fluid 842 disposed in the tank 840. The first finned device 832 causes motion in the fluid 842, which motion causes the second finned device 834 to move.

FIG. 21 illustrates a third embodiment of a viscous coupling 860. The coupling 860 is unlike the couplings 800, 830 in that the coupling 860 does not include finned devices. Instead, a first shaft 862 includes a receptacle 864 formed in its end 866. An end 868 of a second shaft 870 is disposed within the receptacle 864. The shafts 862, 870 are supported such that surfaces 872, 874 of the respective shafts 862, 870 are spaced to define a gap 876 therebetween. A working fluid 878 is disposed in the gap 876. A seal 880 may be disposed, in whole or in part, on one of the shafts 862, 870 to maintain the fluid 878 within the gap 876.

While it will be recognized that still other embodiments are possible for the fluidic or viscous coupling, these embodiments are included as exemplary forms of this coupling.

Alternative Torque Limiters

FIGS. 22-27 illustrate a variety of alternative torque limiters. These limiters may function by decoupling the motor or transmission (if one exists), or converting the torque to another use. These embodiments are not intended to be exemplary of all of the remaining alternative embodiments for carrying out the present disclosure, but merely document additional methods and structures for doing so.

Figure 22:
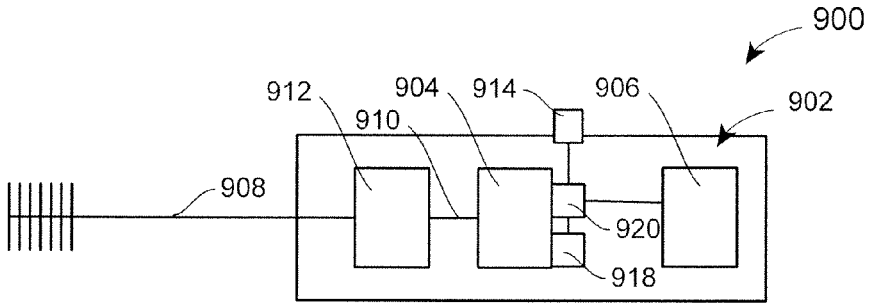
FIG. 22 is schematic of a first alternative torque limiter.

FIG. 22 illustrates a first embodiment of an alternative torque limiter wherein the applicator 900 includes, for example, a drive 902 with an electric motor 904 and a battery 906, and an applicator head 908. The motor 904 has a shaft 910 that is coupled to the head 908 via an optional transmission 912. The motor 904 is coupled to the battery 906 via a switch 914, that may be manipulated (depressed, flipped, etc.) to close the electrical circuit including the motor 904 and the battery 906. According to the present embodiment, the torque limiter may include a current sensor 918 that is coupled to the electrical circuit including the motor 904 and the battery 906, and a drive circuit 920 that is coupled to the current sensor 918 and is also coupled either to the electrical circuit including the motor 904 or is coupled directly to the motor 904. In response to torque demands at the head 908, the current of the electrical circuit may rise. The increase in electrical current may be sensed by the current sensor 918, which provides a signal to the drive circuit 920. The drive circuit 920 is then activated to decouple the motor 904 from the battery 906, or to deactivate the motor 904. Alternatively, where the motor 904 is reversible, the drive circuit 920 may even reverse the direction of the rotational motion of the motor 904 in response to an increase in current indicative of an increase in torque achieved by the head 908.

The decoupling or deactivation may be maintained, for example, for a predetermined amount of time, so as to permit the user an opportunity to manipulate the switch and open the electrical circuit. Alternatively, the decoupling or deactivation may be maintained until the switch is manipulated and the circuit is opened at the switch, thereby permitting the user an opportunity to manipulate the applicator 900 to unbind the lashes without having to remember to manipulate the switch first. In other embodiments, an action beyond that required to open the circuit (i.e., depress the on/off switch) may be required to reset the drive circuit 920 and permit operation of the applicator 900.

Similarly, reversal may be maintained for a predetermined amount of time, and then the motor 904 may be decoupled or deactivated. Alternatively, reversal may be maintained through a predetermined angle, at which point the motor 904 may be decoupled or deactivated. As a further alternative, the speed of reversal may be different than the speed in the forward direction, such that reversal may not be halted until the user manipulates the switch 914, but the difference in speeds may permit the user a greater time window to manipulate the switch 914 with the motor 904 in reverse.

Figure 23A:
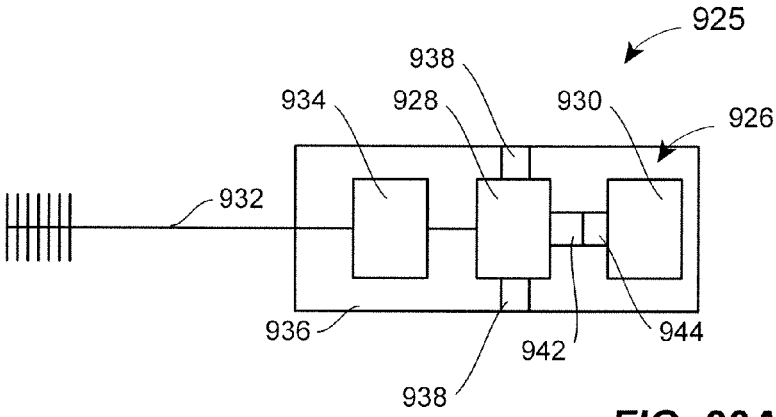
FIGS. 23A and 23B are schematics of a second alternative torque limiter.
Figure 23B:
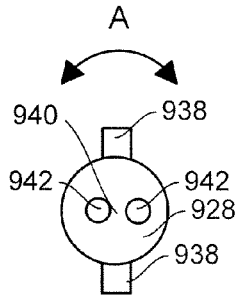
Figure 24:
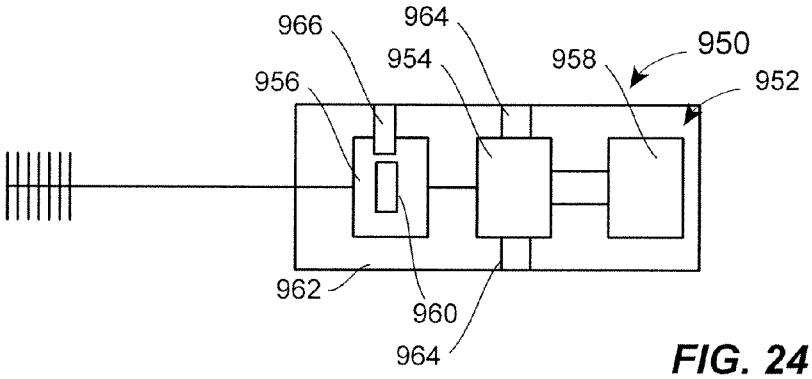
FIG. 24 is a schematic of a third alternative torque limiter.

FIGS. 23A and 23B illustrates a second embodiment of torque limiter wherein the applicator 925 includes, for example, a drive 926 with an electric motor 928 and a battery 930, and an applicator head 932. The drive 926 may also include a transmission 934 coupled between the motor 928 and the applicator head 932, although the transmission 934 is considered optional. The motor 928 is supported in a housing 936 through the use of resilient motor mounts 938, which represent, at least in part, the torque limiter. The resilient motor mounts 938 permit the motor 928 to be selectively coupled to the battery 930 by permitting the motor 928 to move about an axis 940, as represented by the double-headed arrow "A" in FIG. 23B. As seen in FIG. 23A, the motor 928 has contacts 942, which contacts 942 are coupled to (and, for example, aligned with) contacts 944 coupled to the battery 930. If sufficient torque is applied, the motor 928 may move to a different angular positions relative to the battery 930, such that the contacts 942 are no longer coupled to (and, for example, aligned with) the contacts 944. In this fashion, the motor 928 is decoupled from the battery 930, and the motor 928 ceases to function.

FIG. 24 illustrates a third embodiment wherein the applicator 950 includes a drive 952, which may include a motor 954 and a transmission 956. The motor 954 may be an electric motor coupled to a battery 958, although this detail is not necessary to the operation of the torque converter according to this embodiment. Instead, the transmission 956 may include a gear train having at least a first gear 960. Either the gear train 956 or the motor 954 may be supported to a housing 962 of the applicator 950 through resilient mounts 964. According to the illustrated embodiment, the motor 954 is supported by resilient mounts 964, such that the motion of the motor may be similar to that illustrated in FIG. 23A. However, rather than the motor 954 decoupling from the battery 958 when the motor 954 moves from a first to a second angular position, the gear 960 of the gear train 956 abuts a jamb switch 966. With the jamb switch 966 abutting at least the gear 960 (perhaps, lodged between the teeth of the gear 960), the motion of the gear train 956 is limited.

Figure 25A:
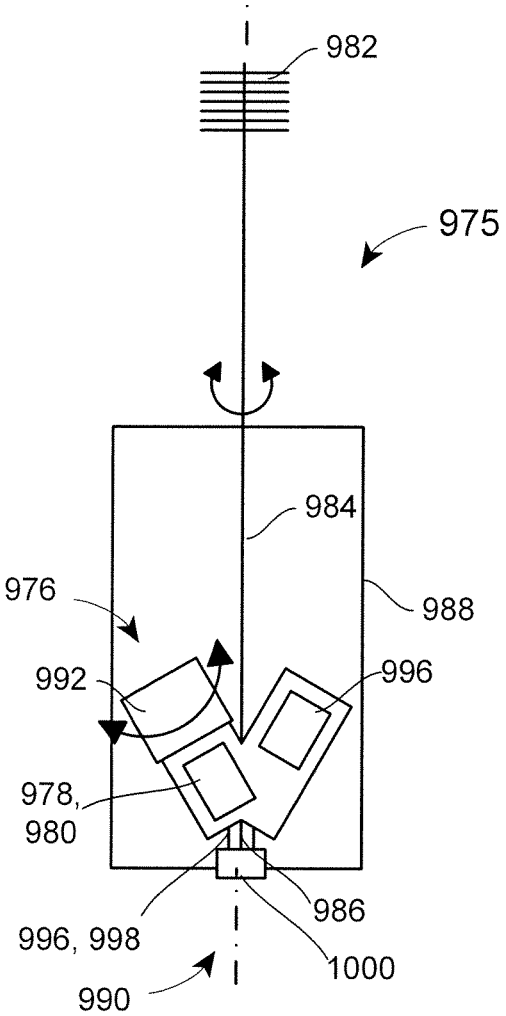
FIGS. 25A and 25B are schematics of a fourth alternative torque limiter.
Figure 25B:
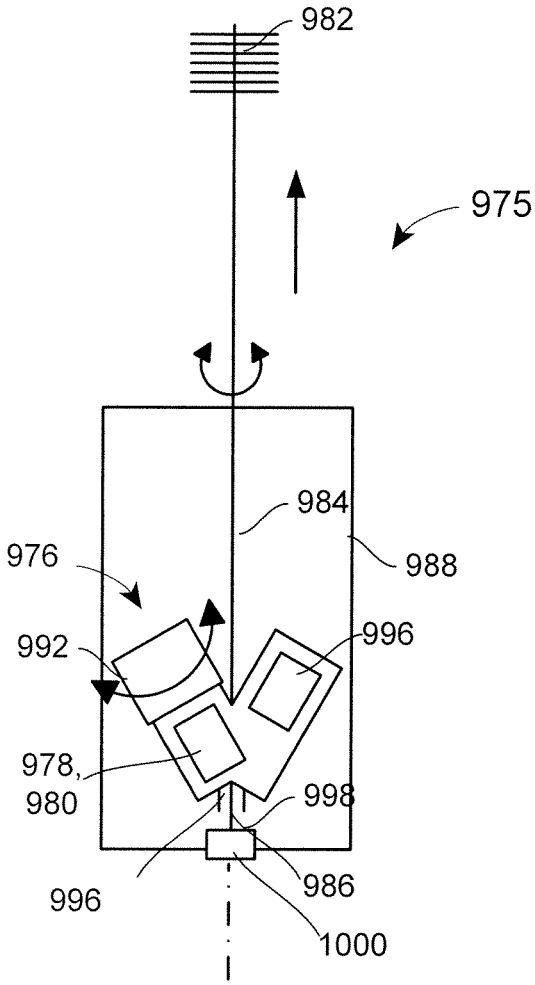

FIGS. 25A and 25B illustrate a further embodiment of torque limiter wherein the applicator 975 includes, for example, a drive 976 with an electric motor 978 and a battery 980, and an applicator head 982. Both the drive 976 and the applicator head 982 are coupled to a sleeve 984 that is mounted for rotation about and translation along a shaft 986 that is fixed coupled to the handle 988 at a first end 990. The drive 976 may also include a weight 992 that is coupled to a shaft of the motor (not shown) and that the motor 978 causes to rotate about an axis common to the motor shaft and the weight 992. The drive 976 may also include a counterweight 996 that is coupled to the sleeve 984 opposite the motor 978 and weight 992.

Further, the drive 976 also includes contacts 996 coupled to the sleeve 984 and contacts 998 coupled to a switch 1000. With the drive 976 in a first, operative state, as is illustrates in FIG. 25A, the contacts 996 and the contacts 998 may be coupled together, permitting the electrical circuit including the motor 978, the battery 980 and the switch 1000 to be closed when the switch 1000 is closed. In this first, operative state, rotation of the motor shaft causes rotation of the weight 992. The rotation of the weight 992 about its axis causes a gyroscopic effect, that causes the sleeve 984 to rotate about the inner shaft 986, which motion is transmitted to the applicator head 982 that is also coupled to the sleeve 984. However, in a second operative state, when the torque applied via the head 982 exceeds a threshold amount, the further rotation of the weight 992 causes a further gyroscopic effect, that advances the sleeve 984 along the inner shaft 986. The translation of the sleeve 984 causes the contacts 996, 998 to decouple, thereby opening the electrical circuit, and deactivating the motor 978. According to the type of motor 978 used, the weight 992 may continue to move even after the contacts 996, 998 are decoupled to ensure that the contacts 996, 998 are spaced, and do not come back into contact with a sudden shifting of the orientation of the handle 988.

FIG. 26 illustrates yet another embodiment wherein the torque limiter 1005 includes a shaft 1006 coupled to the drive 102 and a shaft 1008 coupled to the applicator head 106. An end 1010 of the shaft 1006 and an end 1012 of the shaft 1008 are coupled to opposite ends 1014, 1016 of a resilient member 1018, which may be spring or rubber band. Rather than passing torque between the shafts 1006, 1008, the resilient member 1018 may deform, the stiffness of the resilient member 1018 selected in such a manner to limit the torque experienced by an eyelash enmeshed in the applicator head, for example.

FIG. 27 illustrates another embodiment of torque limiter 1020 including a shaft 1022 having a first portion 1024, which may be coupled to the drive 102, and a second portion 1026, which may be coupled to the head 106. The first portion 1024 and the second portion 1026 of the shaft 1022 may be joined by a destructable region 1028. The destructable region 1028 may be defined, for example, by a region having a lesser diameter than that of the first and second portions 1024, 1026. The destructable region 1028 may fail when a torque is achieved at the head 106 that exceeds a predetermined threshold value. In this fashion, the drive 104 may be decoupled from the head 106. It will be recognized that such an embodiment, because of its destructive failure, may be particularly well suited for use with those embodiments of the applicator 100 that use replaceable subassemblies, such as a replaceable head 106 and stem. It will also be recognized that, according to other embodiments, a destructable protrusion or detachable protrusion may be used in place of the destructable shaft.

Other Aspects of the Applicator

The disclosure now will discuss several embodiments of the aspects of the applicator other than the torque limiter 108, such as the applicator head 106, the drive 102, and so on. It will be recognized that not all embodiments disclosed below may be used with every embodiment of torque limiter 108 discussed above. However, combinations of the various embodiments below with the torque limiters 108 discussed above will be recognized. In this regard, the disclosure of U.S. application Ser. No. 11/143,829 is hereby incorporated herein by reference as to potential variations on the applicator described herein.

First, various embodiments of the applicator head 106 will be discussed relative to FIGS. 28-51.

The applicator head 106 may include one or more elements projecting from the stem for separating and applying cosmetic to keratinous fibers, such as eyelashes. While the applicator element may be provided as a conventional twisted wire brush, the applicator element may instead be in the form of molded protrusions. While protrusions typically extend outwardly away from the base surface, they may also be inverted to project inwardly to form a recess.

According to one embodiment, the molded protrusions are formed as elongate fingers having a base end coupled to the stem and an opposite free end. According to certain embodiments, the cross-sectional area of each finger gradually narrows from the base end to the free end, and each finger is oriented to extend substantially perpendicular with respect to an axis of the stem. It will be appreciated that the fingers may diverge from the base so that the tip is larger, or the fingers may not taper at all but instead have substantially consistent dimensions. Furthermore, the fingers may extend at oblique angles with respect to the stem axis.

The fingers are spaced along the stem and have a free end sized such that each finger may penetrate between adjacent keratinous fibers. The spacing allows the fingers to be inserted between fibers even as the applicator head 106 is rotated, thereby maximizing the fiber surface area engaged by each finger and promoting separation of adjacent fibers. The protrusions should be spaced far enough to allow eyelashes to penetrate between adjacent protrusions yet close enough to separate adjacent eyelashes. Accordingly, the gap between adjacent protrusions may be approximately 0.2 to 3.0 mm.

While in certain embodiments each of the protrusions extends from a localized area of the stem circumference, other areas of engagement between the stem and the protrusions may be used. As illustrated in FIG. 28A-E, for example, each protrusion 1030 may be substantially disc-shaped and have a base end with a substantially annular shape, with a recess or gap 1044 therebetween. In the illustrated embodiment, the base end preferably engages no more than one complete circumference of the stem surface to minimize snagging of the eyelashes as the protrusions 1030 rotate. Other disc shapes traversing more than one complete circumference of the stem may also be used. For example, an elongate stem having a rectangular cross-section may be twisted so that the corners of the stem form localized extensions while the faces of each side of the stem form recesses or gaps between adjacent corners. Protrusions are attached to the surface of the stem to define an irregular or non-uniform applicator head profile generally matching the shape of the stem. The protrusions may have a length that is 10% to 400% of the length of the stem extensions.

Figure 28A:
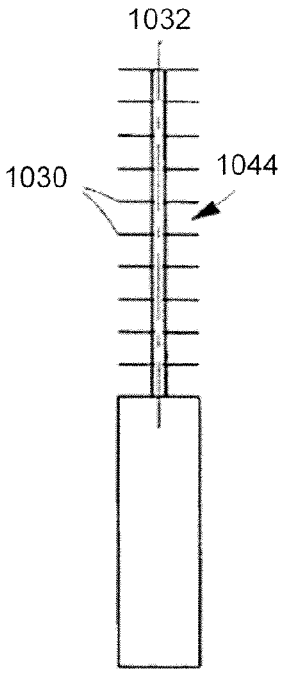
FIGS. 28A-E are side elevation views of alternative protrusion arrangements.
Figure 28B:
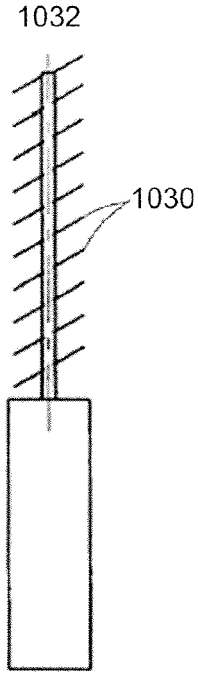
Figure 28C:
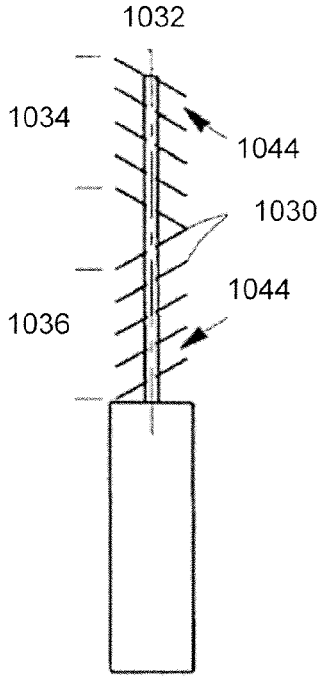
Figure 28D:
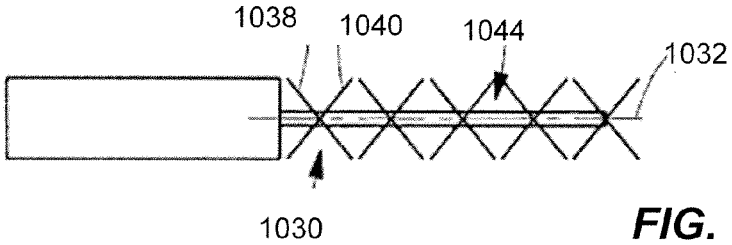
Figure 28E:
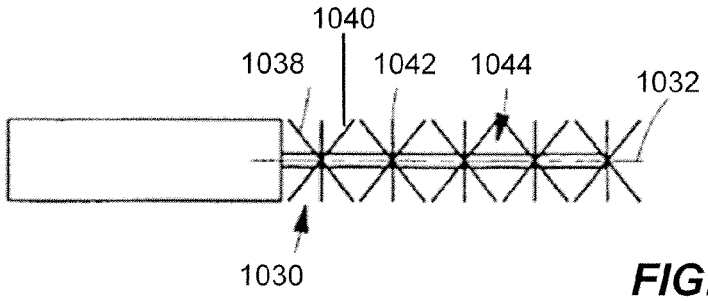

While the disc-shaped protrusion 1030 is illustrated in FIG. 28A as a single molded member, it will be appreciate that the protrusion 1030 may be formed of a plurality of members such as bristles that are arranged in the disc-shaped pattern. The protrusions 1030 may extend substantially perpendicular to the stem axis 1032 to form straight rows of protrusions, similar to that shown in FIG. 28A. Alternatively, all or some of the protrusions 1030 may be oriented at a same oblique angle with respect to the stem axis 1032 to form diagonal rows as illustrated in FIG. 28B, or may include a first set of protrusions 1034 oriented at a first oblique angle and a second set of protrusions 1036 oriented at a second oblique angle different from the first angle to form reverse diagonal rows, as illustrated in FIG. 28C. Each protrusion 1030 may include a first protrusion segment 1038 extending at a first oblique angle and a second protrusion segment 1040 extending at a second oblique angle so that the first protrusion segment intersects the second protrusion segment 1040 to form cross-diagonal rows, as illustrated in FIG. 28D. In addition to the first and second protrusion segments 1038, 1040, each protrusion 1030 may include a third protrusion segment 1042 extending substantially perpendicular to the stem axis 1032 to form combination rows, as illustrated in FIG. 28E. In each of the forgoing embodiments, a circumferential gap 1044 is provided between adjacent protrusions 1030 to allow insertion of the protrusions between adjacent keratinous fibers. Each gap is preferably approximately 0.2 to 3.0 mm to provide sufficient space for an eyelash to penetrate between adjacent protrusions while providing at least some level of eyelash separation.

Figure 29A:
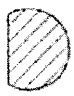
FIGS. 29A-V are cross-sectional views of alternative protrusions.
Figure 29B:
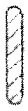
Figure 29C:
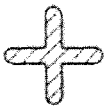
Figure 29D:
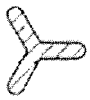
Figure 29E:
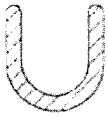
Figure 29F:
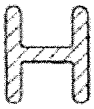
Figure 29G:
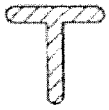
Figure 29H:
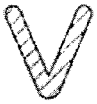
Figure 29I:
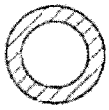
Figure 29J:
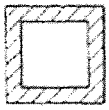
Figure 29K:
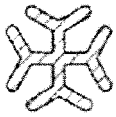
Figure 29L:
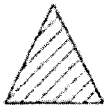
Figure 29M:
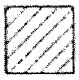
Figure 29N:
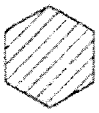
Figure 29O:
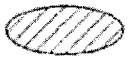
Figure 29P:
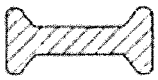
Figure 29Q:
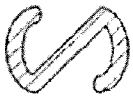

The cross-sectional shape of the protrusions 1030 may be varied without departing from the scope of this disclosure. As illustrated in FIGS. 28A-E, the protrusions are provided as fingers having substantially circular cross-sectional shapes. The protrusions may have various types of cross-sectional shapes in additional to circular, such as any one of the shapes shown diagrammatically in FIGS. 29A-V, for example a circular shape with a flat as shown in FIG. 29A, a flat shape as shown in FIG. 29B, a star shape, e.g. in the form of a cross as shown in FIG. 29C, or having three branches as shown in FIG. 29D, a U-shape as shown in FIG. 29E, an H-shape as shown in FIG. 29F, a T-shape as shown in FIG. 29G, a V-shape as shown in FIG. 29H, a hollow shape, e.g. a circular shape as shown in FIG. 29I, or a polygonal shape in particular a square shape as shown in FIG. 29J, a shape that presents ramifications, e.g. a snowflake shape as shown in FIG. 29K, a polygonal shape, e.g. a triangular shape as shown in FIG. 29L, a square shape as shown in FIG. 29M, or a hexagonal shape as shown in FIG. 29N, an oblong shape, in particular a lens shape as shown in FIG. 29O, or an hourglass shape as shown in FIG. 29P. It is also possible to use protrusions having portions which are hinged relative to one another as shown in FIG. 29Q.

Figure 29R:
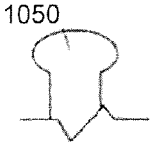
Figure 29S:
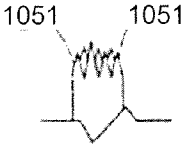
Figure 29T:
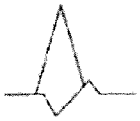
Figure 29U:
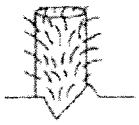
Figure 29V:
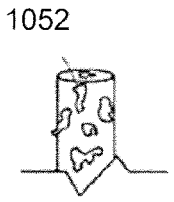

The ends of the protrusions may be formed with various shapes or include various structures. Where appropriate, the protrusions may be subjected to treatment for forming respective end balls 1050 as shown in FIG. 29R, end forks 1051 as shown in FIG. 29S, or tapering tips as shown in FIG. 29T. The protrusions may also be flocked as shown in FIG. 29U or made by extruding a plastic material containing a filler of particles 1052 so as to impart micro-relief to the surface of the bristles as shown in FIG. 29V or so as to confer magnetic or other properties thereon.

The protrusions may have an exterior surface particularly adapted to transfer cosmetic material from a base of the protrusion to a free end. For example, each protrusion may include an exterior coating having a low surface energy to more readily transfer product to the lashes. The coating may be particularly suited for use with cosmetic material, such as the mascara materials noted above in the background.

Figure 30A:
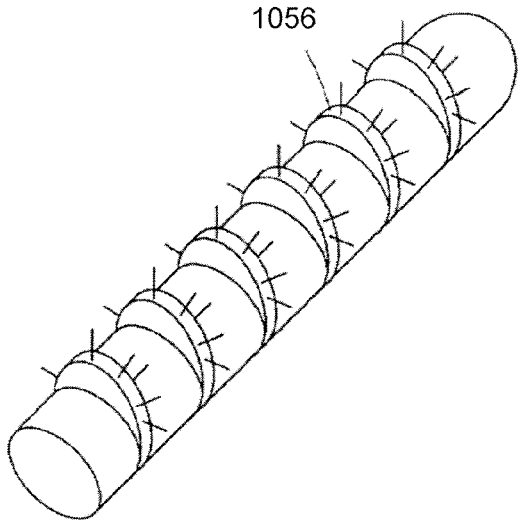
FIGS. 30A and 30B are perspective views of alternative protrusions.
Figure 30B:
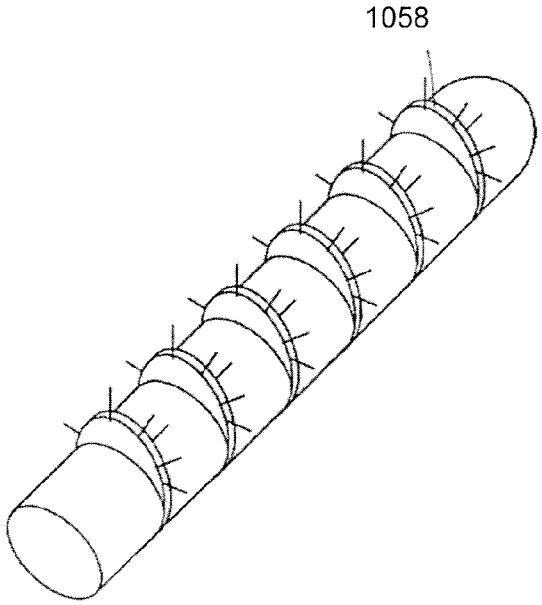

In addition to the elongate profile, at least some of the protrusions may be somewhat shorter, such as protruding discs 1056, dimples, or ridges 1058 extending from an exterior surface of the stem, as illustrated in FIGS. 30A and 30B. Still further, protrusions having a broad range of flexibility or stiffness may be used.

Figure 31A:
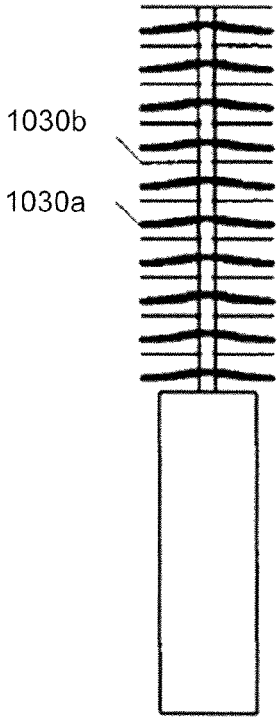
FIGS. 31A-C are plan and side views of a combination of flexible and stiff protrusions.
Figure 31B:
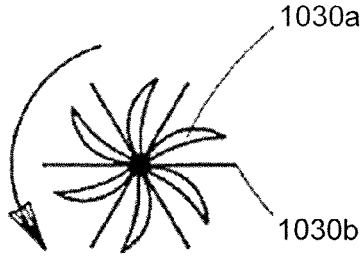
Figure 31C:
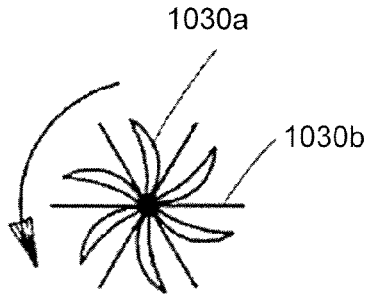

The applicator head 106 may include a variety of protrusions having different shapes or displaying different properties. For example, the applicator head 106 may include a first set of protrusions having a first cross-sectional shape and a second set of protrusions having a second cross-sectional shape. Also, the first set of protrusions 1030*a* may have a first stiffness while the second set of protrusions 1030*b* has a second, different stiffness. By using protrusions of varying stiffness, rotation of the applicator head will cause the more flexible protrusions to deflect to a greater degree than the stiffer protrusions, as illustrated in FIGS. 31A-31C.

Figure 32A:
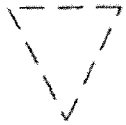
FIGS. 32A-K are cross-sectional views of alternative stems.
Figure 32B:
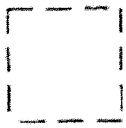
Figure 32C:
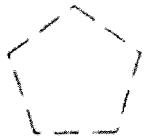
Figure 32D:
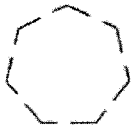
Figure 32E:
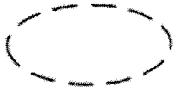
Figure 32F:
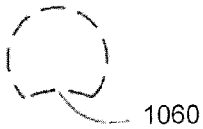
Figure 32G:
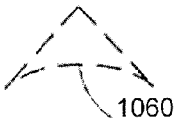
Figure 32H:
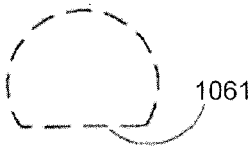
Figure 32I:
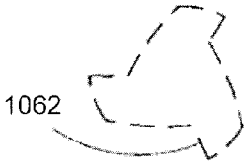
Figure 32J:
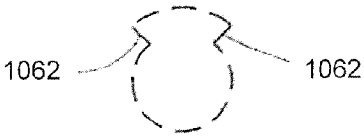
Figure 32K:
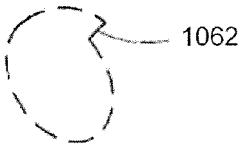
Figure 32L:
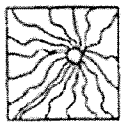
FIG. 32L illustrates an off-center stem.

The stem also may have one of a variety of cross-sectional shapes, as illustrated in FIGS. 32A-32K. The stem may have a uniform, circular cross-section or a non-circular shape such as the polygonal, e.g. triangular section shown in FIG. 32A. As further examples, the stem may have a square cross-sectional shape as shown in FIG. 32B, a pentagonal shape as shown in FIG. 32C, a hexagonal shape as shown in FIG. 32D, or an oval shape as shown in FIG. 32E. The stem may have at least one notch area 1060, which may be outwardly concave as shown in FIGS. 32F and 32G, wherein the notch presents a cross-section that is constant or otherwise. The notch 1060 may be made in a circular cross-sectional shape as shown in FIG. 32F, or a non-circular cross sectional shape, e.g., triangular section, as shown in FIG. 32G. In the triangular case (FIG. 32G), the notch may constitute an entire side of the triangle as shown, in which case the applicator presents a facet that is concave. The stem shape may include a plane facet 1061, as illustrated in FIG. 32H. The profile may alternatively include at least one indentation 1062, such as the three indentations shown in FIG. 32I. A stem shape having two indentations 1062 is shown in FIG. 32J, while a stem shape with one indentation 1062 is shown in FIG. 32K. The applicator head 106 may define a cross-sectional profile that is constant or otherwise, and its core may be rectilinear or otherwise. The stem may be centered or off-center relative to the outline of the cross-sectional profile, as shown in FIG. 32L.

Figure 33A:
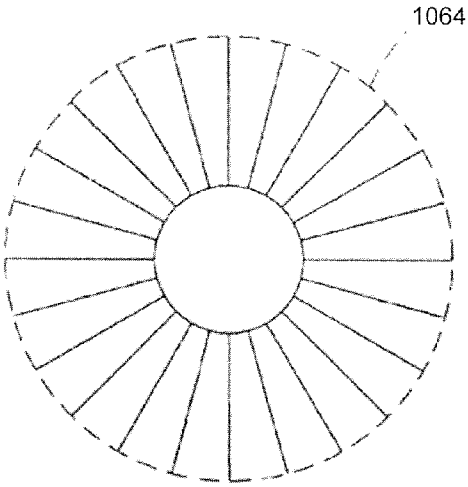
FIGS. 33A-M are end views of alternative protrusion distributions.
Figure 33B:
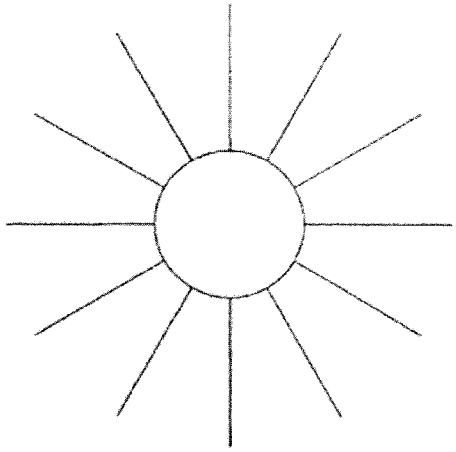
Figure 33C:
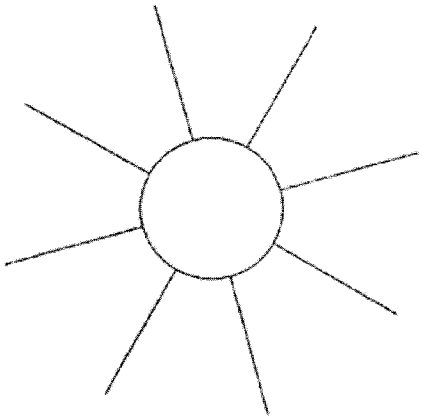
Figure 33D:
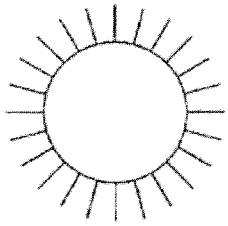

The protrusions may have a variety of lengths so as to define a variety of applicator head profiles. For example, the protrusions may be of uniform length to define a circular applicator head profile 1064, as shown in FIG. 33A. The protrusions may be closely spaced as shown in FIG. 33A, intermediately spaced as shown in FIG. 33B, or remotely spaced as shown in FIG. 33C. Additionally, each protrusion may have a relatively longer length as shown in FIG. 33A or a relatively shorter length as shown in FIG. 33D.

Figure 33E:
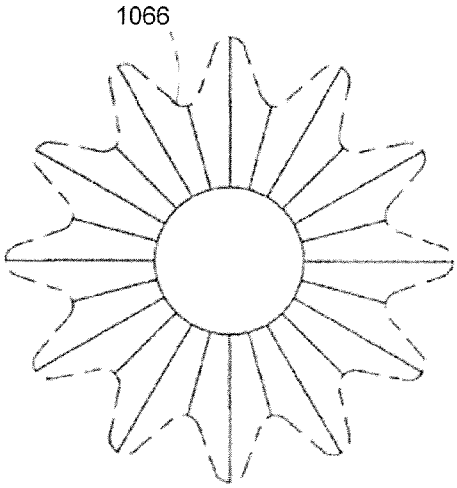
Figure 33F:
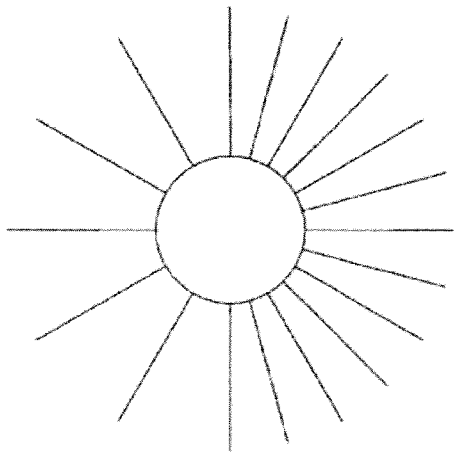
Figure 33G:
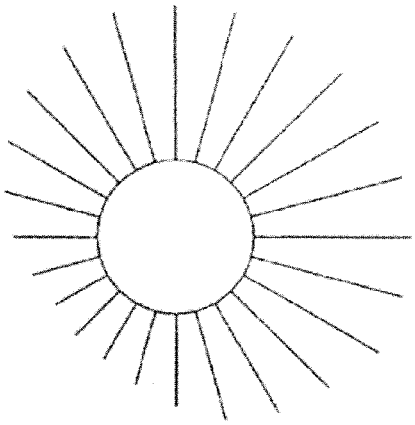
Figure 33H:
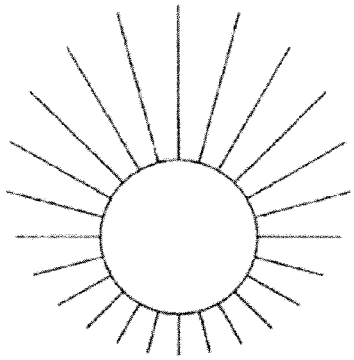
Figure 33I:
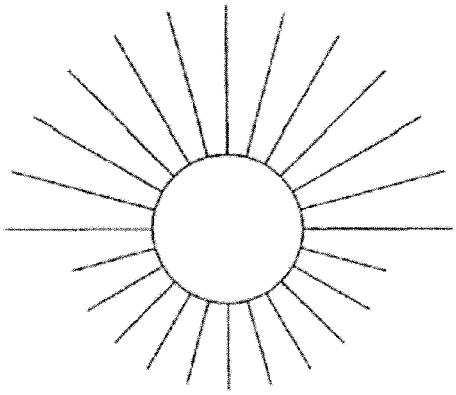
Figure 33J:
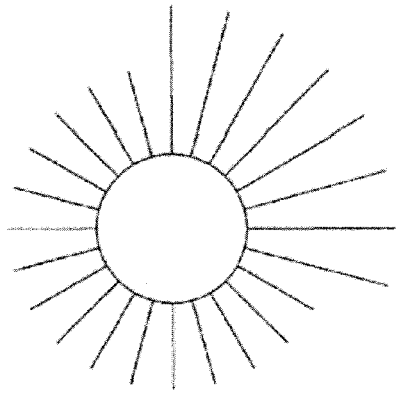
Figure 33K:
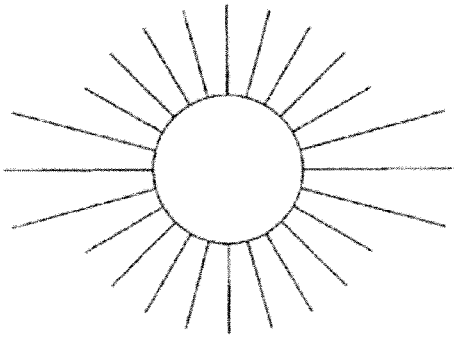
Figure 33L:
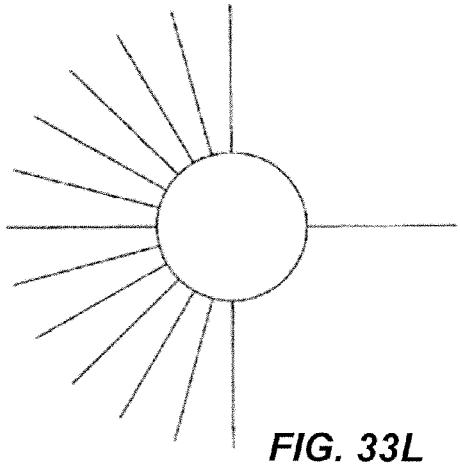
Figure 33M:
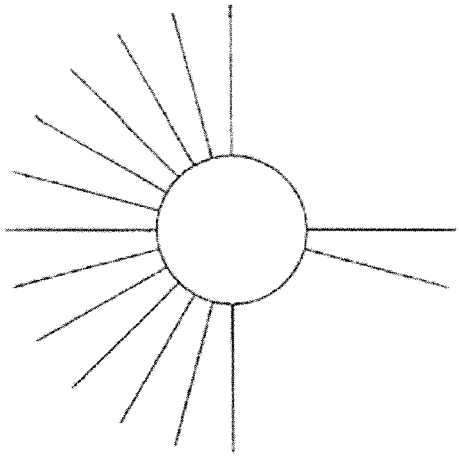
Figure 34A:
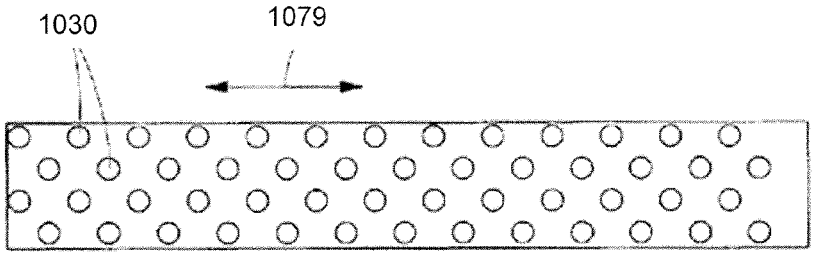
FIGS. 34A-D are four side views of various quadrants of an applicator head.
Figure 34B:
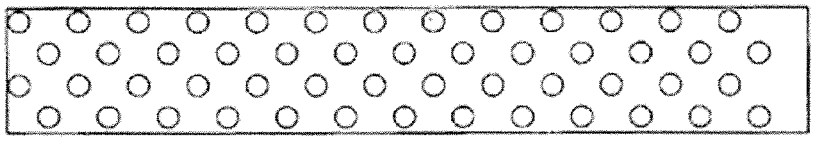
Figure 34C:
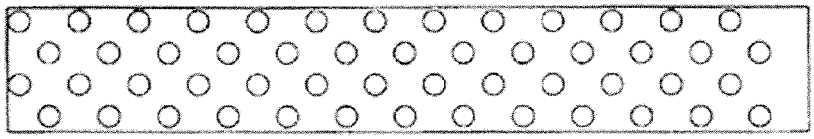
Figure 34D:
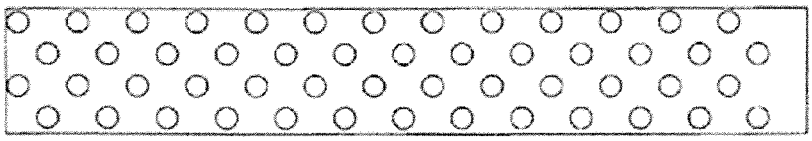
Figure 35A:
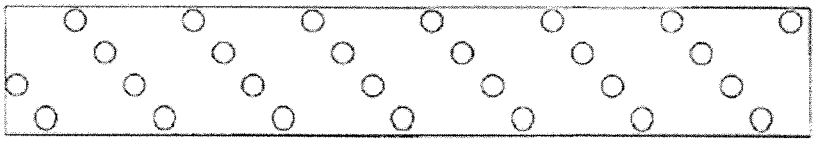
FIGS. 35A-D are four side views of various quadrants of an applicator head.
Figure 35B:
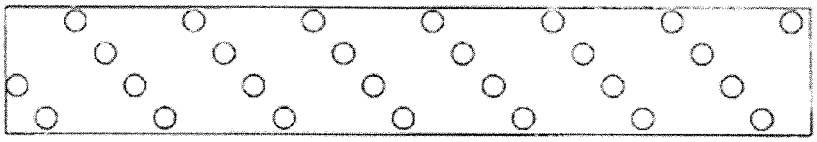
Figure 35C:
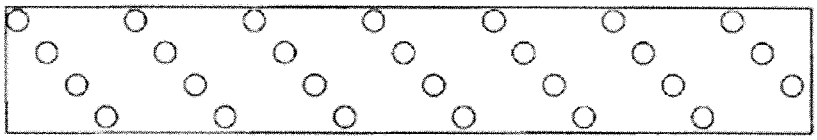
Figure 35D:
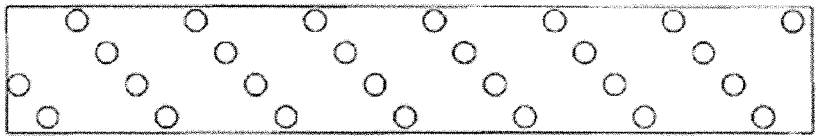
Figure 36A:
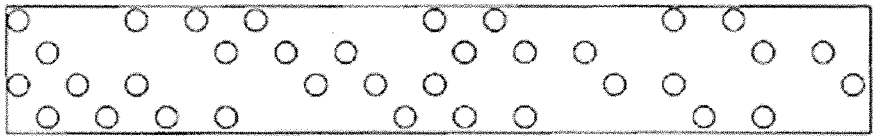
FIGS. 36A-D are four side views of various quadrants of an applicator head.
Figure 36B:
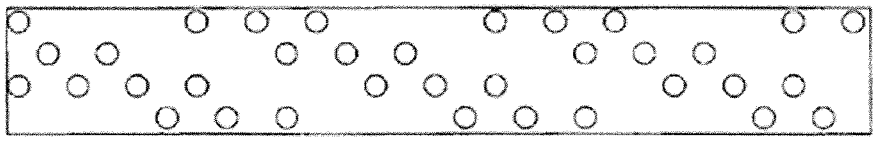
Figure 36C:
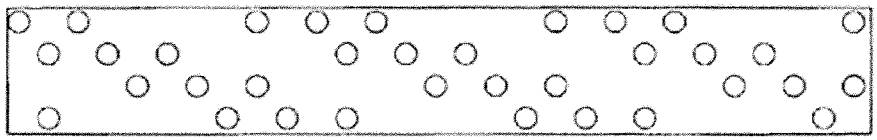
Figure 36D:
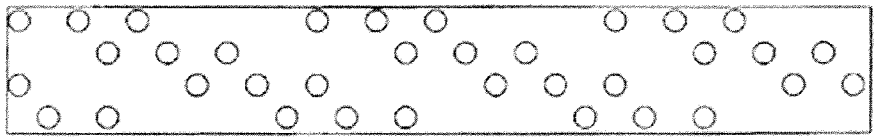
Figure 37A:
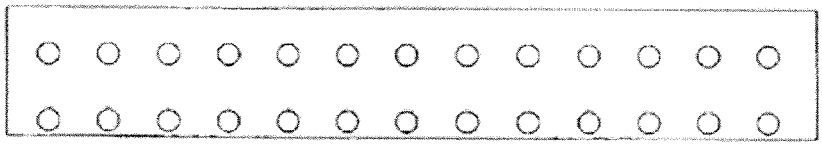
FIGS. 37A-D are four side views of various quadrants of an applicator head.
Figure 37B:
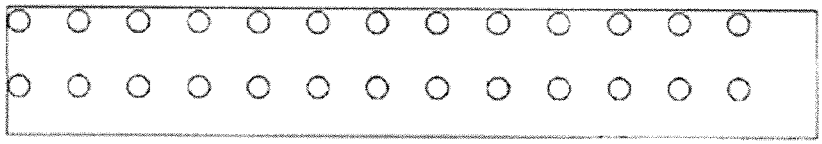
Figure 37C:
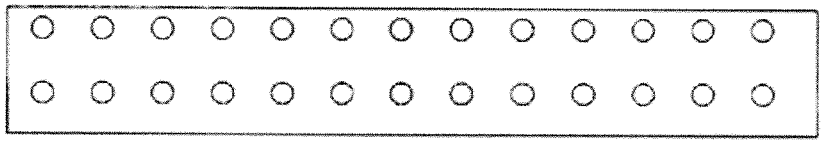
Figure 37D:
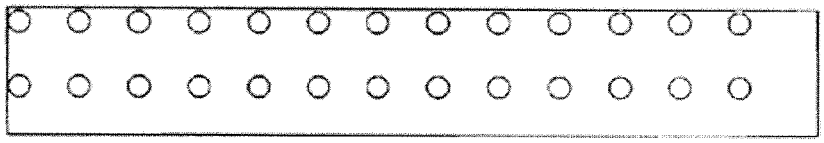
Figure 38A:
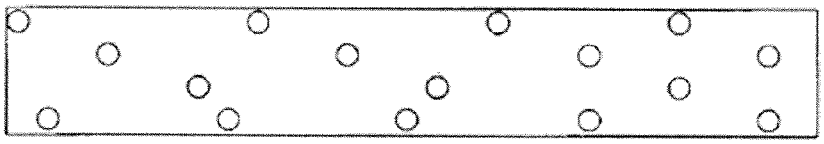
FIGS. 38A-D are four side views of various quadrants of an applicator head.
Figure 38B:
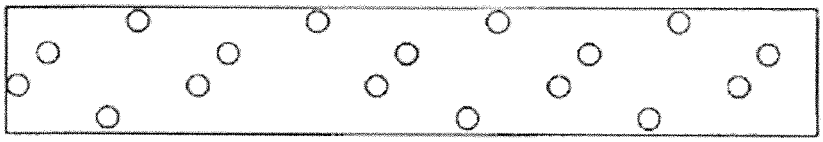
Figure 38C:
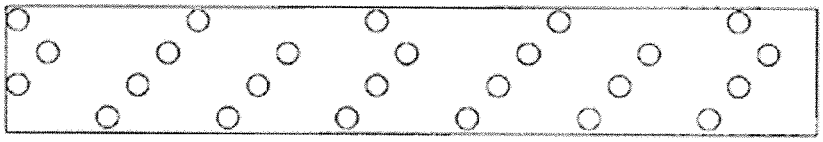
Figure 38D:
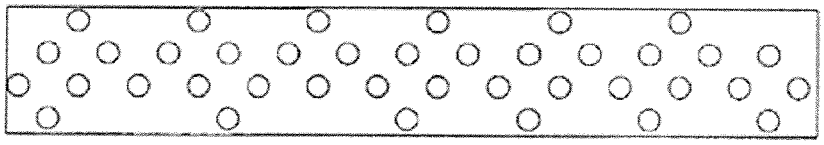
Figure 39A:
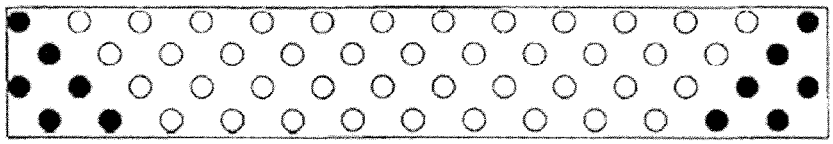
FIGS. 39A-D are four side views of various quadrants of an applicator head.
Figure 39B:
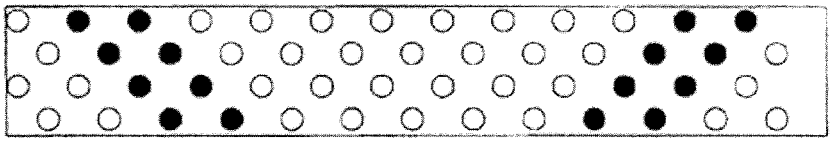
Figure 39C:
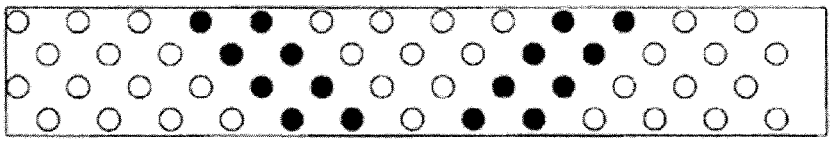
Figure 39D:
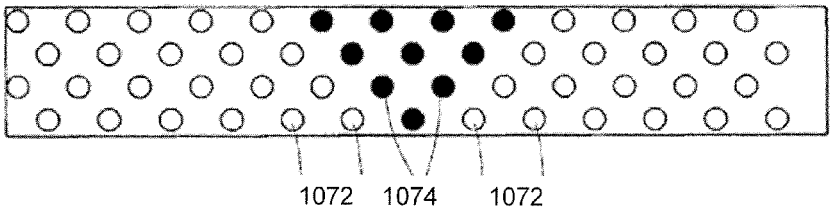
Figure 40A:
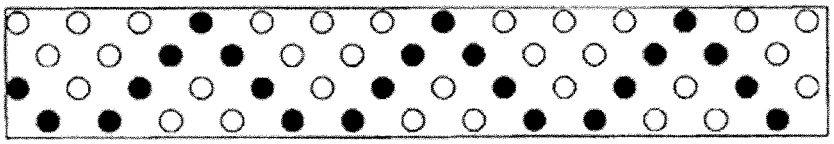
FIGS. 40A-D are four side views of various quadrants of an applicator head.
Figure 40B:
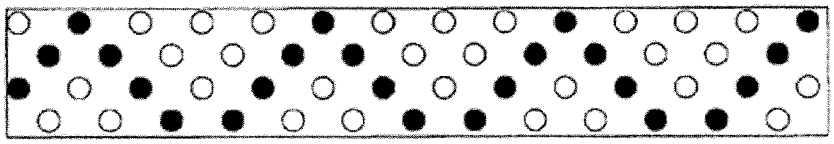
Figure 40C:
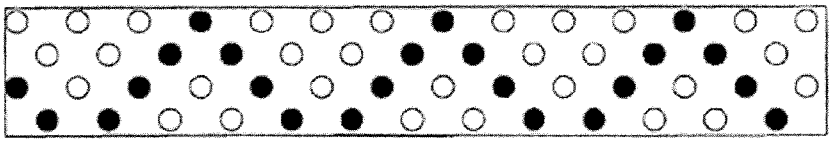
Figure 40D:
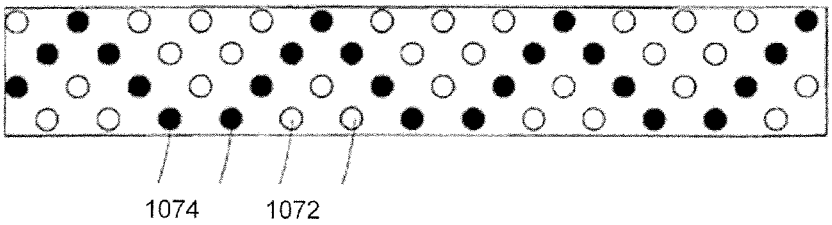

Alternatively, the shape of the stem and/or the length and spacing of the protrusions may be varied to define a non-circular applicator head profile. For example, the length of the protrusions may alternate between short and long lengths around the circumference of the stem to define a cross-sectional applicator head profile 1066 having recesses, as shown in FIG. 33E. One half of the applicator may include more closely spaced protrusions while the other half of the applicator may have farther spaced protrusions to provide an applicator head having sections of varying density, as illustrated in FIG. 33F. The applicator head may include protrusions of several different lengths to define an irregular applicator head profile as shown in FIGS. 33G and 33H. Other possible embodiments include one half of the applicator having shorter protrusions while the other half of the applicator head 106 having longer protrusions, as shown in FIG. 33I; one quadrant of the applicator head 106 having longer protrusions while the remaining three quadrants of the applicator head have shorter protrusions as shown in FIG. 33J; opposing sections of longer and shorter protrusions as shown in FIG. 33K; one half of the applicator head 106 having densely spaced protrusions while the other half includes a single protrusion as shown in FIG. 33L; and one half of the applicator including a plurality of densely spaced protrusions while the other half includes a pair of protrusions as shown in FIG. 33M.

In addition to varying the circumferential spacing of the protrusions, the axial spacing of the protrusions along the applicator head 106 may also be varied. FIGS. 34A-D illustrate four quadrants of an applicator head 106 having protrusions 1030 that are substantially uniformly spaced in the axial direction, indicated by arrow 1070. The pattern of protrusions is uniform to create alternating or staggered rows of protrusions lying in a plane extending substantially perpendicular to the stem axis 1032. FIGS. 35A-D illustrate four quadrants of an applicator head 106 having uniformly spaced protrusions lying in a plane extending at an oblique angle with respect to the stem axis 1032. FIGS. 36A-D illustrate four quadrants of an applicator head 106 having non-uniformly spaced protrusions forming a repeating pattern having areas of closer spaced protrusions and areas of farther spaced protrusions. FIGS. 37A-D illustrate four quadrants of an applicator head 106 having uniformly spaced protrusions forming aligned rows of protrusions lying in a plane extending substantially perpendicular to the stem axis 1032. FIGS. 38A-D illustrate four quadrants of an applicator head in which each quadrant has a different pattern of protrusions.

The applicator head 106 may include patterns of protrusions having different lengths. As shown in FIGS. 39A-D, four quadrants of an applicator head are shown having uniformly spaced protrusions. The pattern includes shorter protrusions 1072 (illustrated in a lighter tone) and longer protrusions 1074 (illustrated in a darker tone). The shorter protrusions may be upright to project outwardly from the stem surface, or may be inverted to extend into the stem, and therefore may be 0-400% shorter than the longer protrusions. The shorter protrusions 1072 form a V-shaped pattern extending through a rectangular field of longer protrusions 1074. FIGS. 40A-D illustrate four quadrants of an applicator head in which the shorter protrusions 1072 form a grid pattern while the longer protrusions 1074 form a repeating square pattern inside each grid.

The applicator may include visible indicia to identify portions of the applicator having different characteristics. An asymmetrical applicator head, for example, may include a first area having protrusions with a first characteristic and a second area having protrusions with a second characteristic. The applicator head may have a first visible indicia, such as color, texture, text, or other visually discernable quality, to identify the first area and a second visible indicia to identify the second area. The different visible indicia communicate to a user that the different areas have protrusions with different characteristics, such as relative flexibilities, lengths, or motions. The visible indicia may be provided as different colors in the first and second areas. For example, the protrusion tip, entire protrusion body, or applicator head surface including protrusions associated with the first area may have a first color, while similar structure in the second area has a second color. Similarly, the first area may have a first color scheme, such as an applicator head surface with a first color and protrusions or portions thereof with a second color, while the second area has a second color scheme, such as an applicator head surface with a third color and protrusions or portions thereof with a fourth color.

Having discussed various embodiments of the applicator head, the disclosure now references several embodiments of the drive 104.

Figure 41:
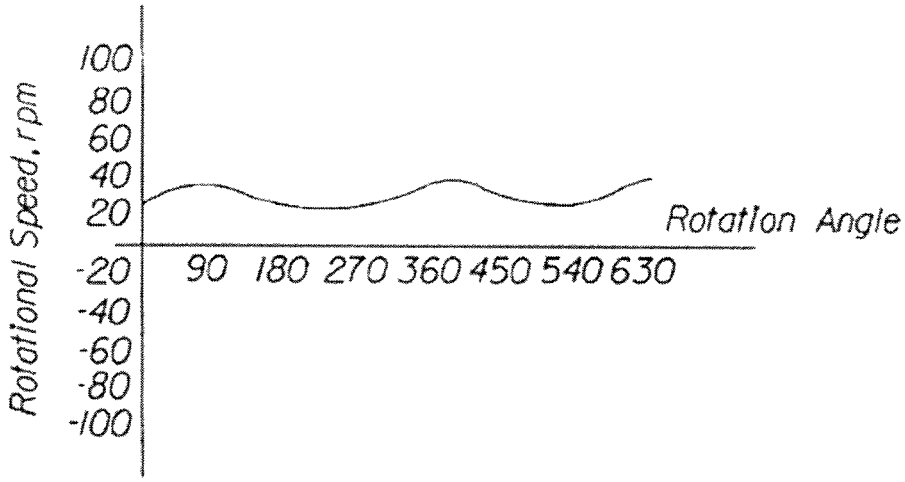
FIG. 41 is a graph of a sinusoidal speed variation plotted with rotation speed as a function of angle position.
Figure 42:
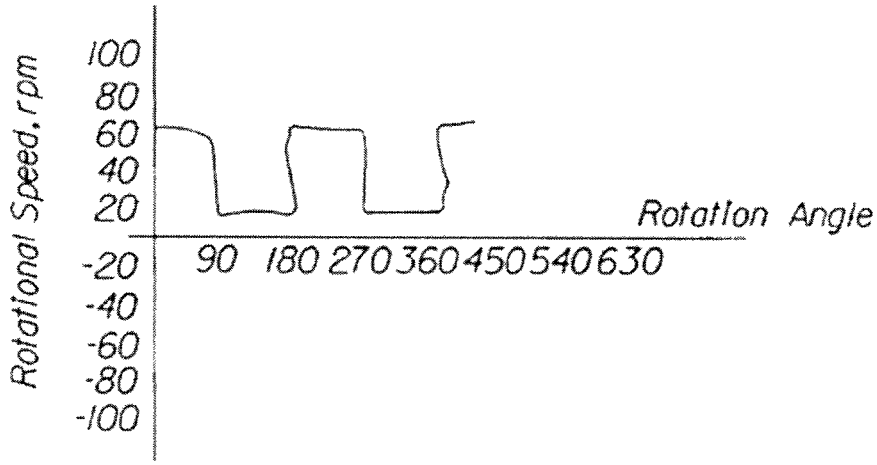
FIG. 42 is a graph of a step-wise speed variation plotted with rotational speed as a function of angle position.

As noted above, according to certain embodiments of the motor, the speed may vary. FIGS. 41 and 42 illustrate speed varying with angle position (although the variations could have alternatively been plotted relative to time, for example). A drive circuit may be provided, as indicated above, for producing more complex movements of the applicator head 106. For example, the drive circuit may provide a dynamic speed signal to the motor 120 to automatically adjust the rotational speed of the applicator head 106. The dynamic signal may generate a generally repeating speed pattern, such as a varying speed according to the degrees of shaft rotation, as illustrated by the graphs shown in FIGS. 41 and 42. In FIG. 41, the graph illustrates a gradually, generally sinusoidal speed fluctuation according to shaft rotation. In contrast, the graph in FIG. 42 illustrates an abrupt, step change in speed according to shaft rotation.

As also noted above, a variety of different drives exist for generating a rotational motion component. For example, an applicator 1130 is illustrated in FIGS. 43A-E in which motor rotation in a single direction is converted into a rotating oscillation motion. The applicator 1130 includes a handle 1132 and an applicator head 1134 with applicator elements 1136. The applicator also includes a drive 1139. The drive 1139 includes a drive motor 1138 and a battery 1140, the motor 1138 and battery 1140 being operatively coupled together and disposed inside the handle 132. The motor 1138 has a motor shaft 1142 that is mechanically coupled to the applicator head 1134 by a transmission 1144.

More specifically, the transmission 1144 includes a motor disc 1146 coupled to the rotating motor shaft 1142. As best seen in FIGS. 43B-E, the motor disc 1146 includes a pin 1148 sized for insertion into a slot 1150 formed in a connecting rod 1152. The connecting rod 1152 is pivotally coupled to a first end of an idler rod 1154. A second end of the idler rod 1154 is fixed to the applicator head 1134, so that the idler rod 1154 and applicator head 1134 rotate together. A spring 1156 extends between the handle 1132 and the idler rod 1154 to bias the idler rod 1154 in a first direction.

Figure 43B:
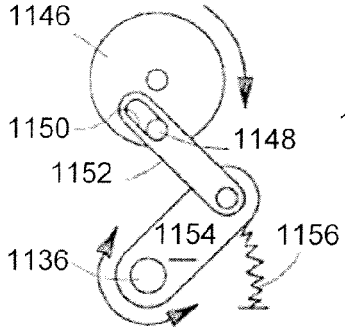
FIGS. 43B-E are fragmentary side views of the drive illustrated in FIG. 43A.
Figure 43C:
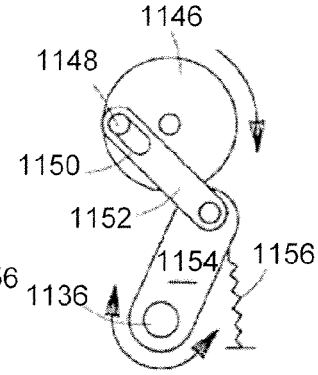
Figure 43D:
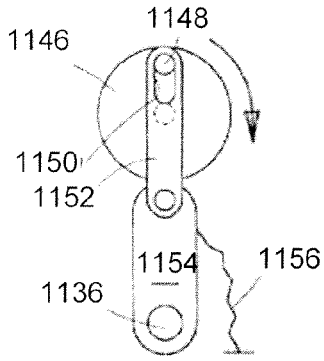
Figure 43E:
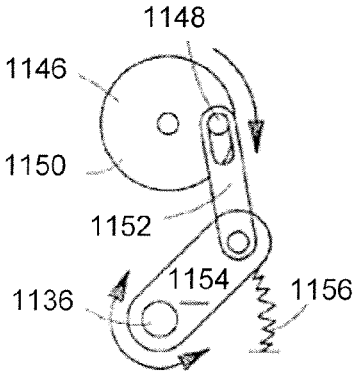
Figure 43A:
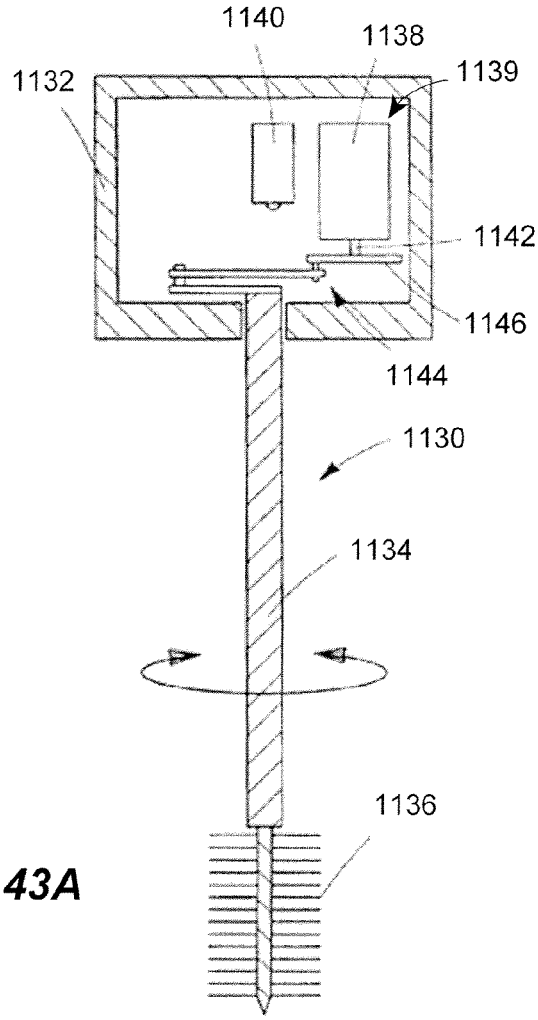
FIG. 43A is a cross-sectional view of an applicator with a drive that generates rotational motion.

In operation, the pin 1148 may first be positioned adjacent a lower end of the slot 1150 as shown in FIG. 43B. As the motor disc 1146 rotates clockwise, the pin 1148 moves from the lower end to the upper end of the slot 1150, as shown in FIG. 43C. As the pin 1148 continues to rotate upwardly, the connecting rod 1152 and idler rod 1154 are pulled in a vertically upward direction illustrated in FIG. 43D, thereby causing a counter-clockwise rotation of the stem 1134. From the position shown in FIG. 43D, further rotation of the motor disc 1146 moves the pin 1148 downwardly to slide from the upper end to the lower end of the slot 1150, as shown in FIG. 43E. Further rotation of the motor disc 1146 drives the connecting rod 1152 and idler rod 1154 downwardly back to the position shown in FIG. 43B, thereby to rotate the stem 1134 in a clockwise direction. Accordingly, the transmission coupling 1144 converts uni-directional rotation of the motor shaft 1142 into a rotating oscillation of the stem 1134.

Figure 44A:
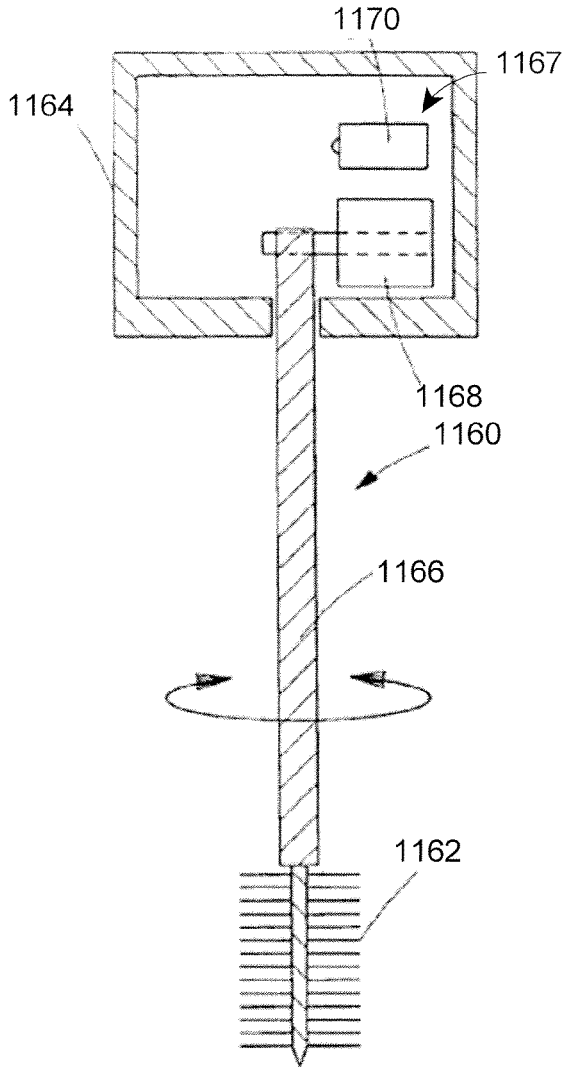
FIG. 44A is a cross-sectional view of an applicator with a drive that generates rotational motion.
Figure 44B:
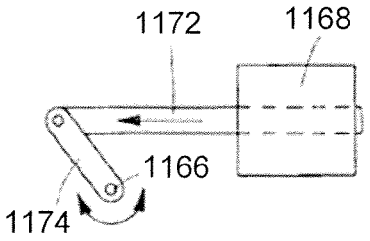
FIGS. 44B and 44C are fragmentary side views of the drive illustrated in FIG. 44A.
Figure 44C:
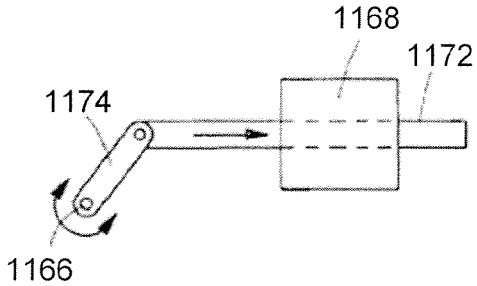

Another exemplary embodiment of an applicator 1160 with a rotational movement is illustrated in FIGS. 44A-C. The applicator 1160 includes a handle 1164 and an applicator head 1166 with applicator elements 1162. A drive 1167 includes an electrical coil actuator 1168 and battery 1170, both disposed in the handle 1164 and operatively coupled together. The coil actuator 1168 reciprocates a drive shaft 1172 along an axis of the shaft 1172. The drive shaft 1172 is pivotally coupled to a first end of an idler shaft 1174. A second end of the idler shaft 1174 is fixed to and rotates with the applicator head 1166. In operation, the actuator 1168 reciprocates the drive shaft 1172 between extended and retracted positions, illustrated in FIGS. 44B and 44C, respectively. As the drive shaft 1172 moves from the extended position to the retracted position, the idler shaft 1174 and attached stem 1166 are rotated in a clockwise direction. When the drive shaft 1172 moves in the reverse direction from the retracted position to the extended position, the idler shaft 1174 and applicator head 1166 are rotated in the counter-clockwise direction. The speed of rotation and time periods during which the applicator head 1166 is rotated in the forward and reverse directions may be determined by the coil actuator 1168, the battery 1170, and/or a controller (not shown).

Figure 45A:
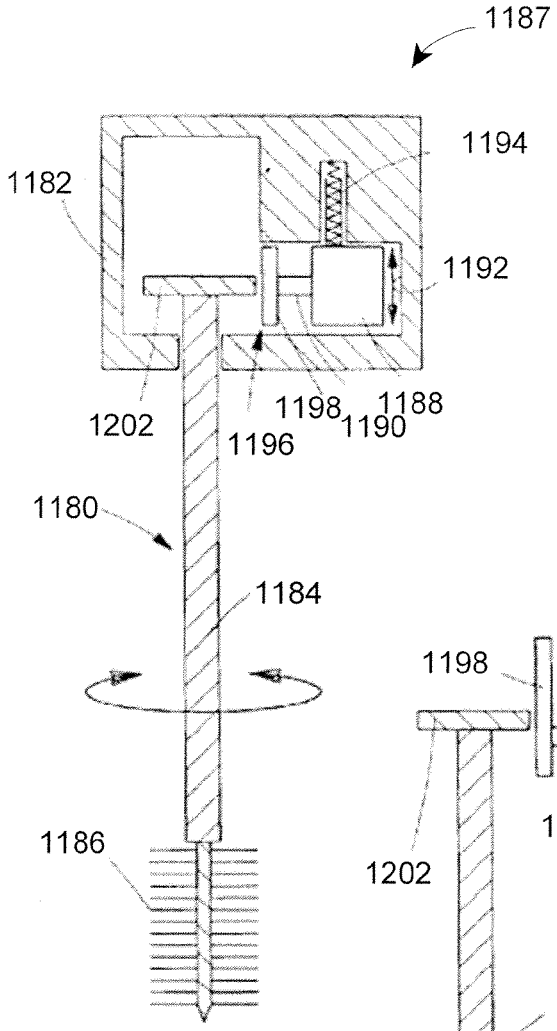
FIG. 45A is a cross-sectional view of an applicator with a drive that generates rotational motion.
Figure 45B:
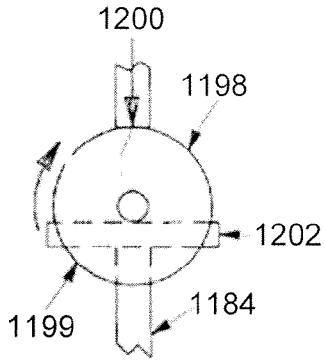
FIG. 45B is a fragmentary side views of the drive illustrated in FIG. 45A.
Figure 45C:
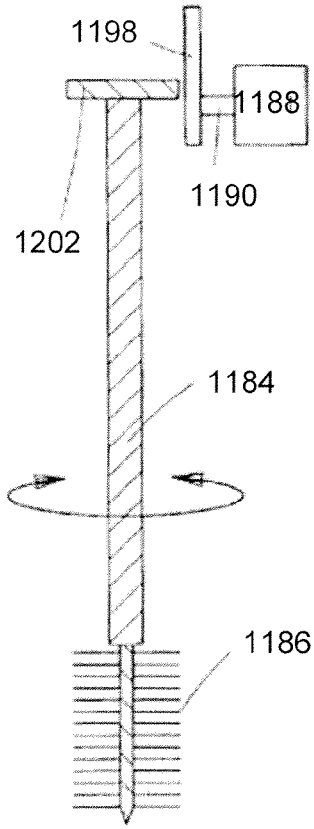
FIGS. 45C and 45D are a cross-sectional views of the applicator illustrated in FIG. 45A.
Figure 45D:
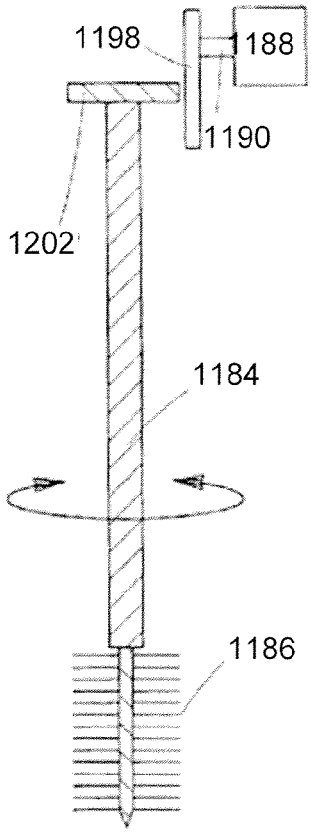

Another further exemplary embodiment of an applicator 1180 is illustrated in FIGS. 45A-D. The applicator 1180 includes a handle 1182 and a applicator head 1184 with applicator elements 186. As shown in FIG. 45A, a drive 1187 includes a motor 1188 having a rotating motor shaft 1190 is disposed in an oversized cavity 1192 formed in the handle 1182 and biased toward a downward position by a spring 1194. A transmission 1196 is provided to operably couple the motor shaft 1190 to the applicator head 1184. The transmission 1194 includes a motor disc 1198 having an oblong shape defining a cam surface 1199, as best shown in FIG. 45B, and engages a fixed surface 1200 in the handle 1182 to provide a cam action as the motor disc 1198 rotates. The motor disc 1198 frictionally engages a applicator head disc 1202 attached to the applicator head 1184. In operation, the motor 1188 rotates the motor disc 1190 which drives the applicator head disc 1202. As the motor disc 1198 rotates, the motor 188 is driven up and down by the cam action of the motor disc 1198 against the fixed surface 1200. The center of rotation of the motor disc 1198 therefore moves above and below the elevation of the applicator head disc 1202. When the center of motor disc rotation is above the elevation of the applicator head disc 1202 as shown in FIG. 45D, the applicator head 1184 is rotated in a clockwise direction. Conversely, when the center of motor disc rotation is below the elevation of the applicator head disc 1202 as shown in FIG. 45C, the applicator head 1184 is rotated in a counter-clockwise direction. It will be appreciated that as the center of motor disc rotation moves farther away from the elevation of the applicator head disc 1202, the applicator head disc is rotated at a faster speed. Accordingly, the transmission coupling 1196 converts a uni-directional motor rotation into a rotating oscillation of the applicator head in which the speed of rotation varies in both the forward and reverse rotation directions.

Figure 46A:
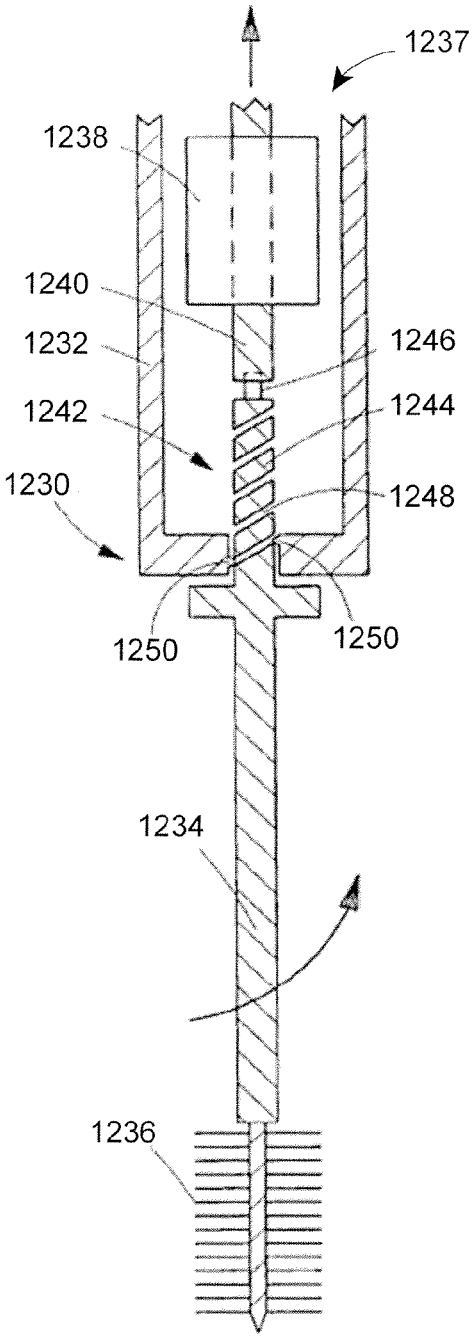
FIGS. 46A and 46B are cross-sectional views of an applicator with a drive that generates axial and rotational motion.
Figure 46B:
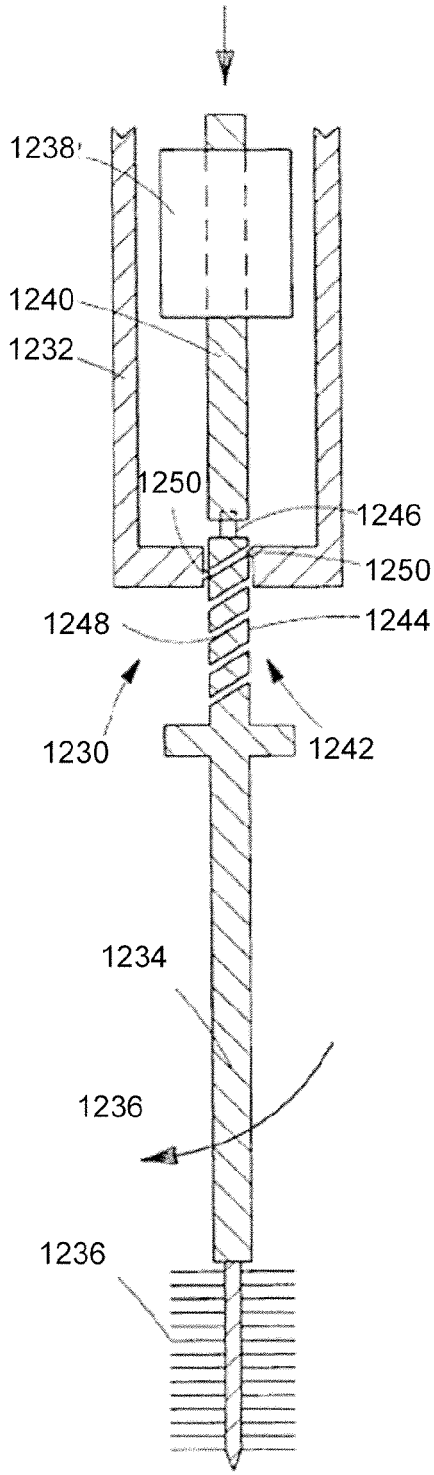

It will be recognized that the applicator 100 may include a drive 102 that moves the applicator head 106 not only in a rotational motion, but an axial motion as well. An exemplary embodiment of an applicator 1230 capable of producing a composite motion including both rotational and axial oscillation is illustrated in FIGS. 46A and 46B. The applicator 1230 includes a handle 1232 and an applicator head 1234 with applicator elements 1236. The applicator 1230 also includes a drive 1237, with a coil actuator 1238 disposed in the handle 1232 and a drive shaft 1240. A transmission 1242 is provided for operably connecting the applicator head 1234 to the drive shaft 1240. Specifically, the transmission 1242 includes a applicator head extension 1244 connected to the drive shaft 1240 by a flexible coupling 1246, which allows rotation of the applicator head extension 1244 with respect to the drive shaft 1240. The applicator head extension 1244 includes a spiral groove 1248 sized to receive projections 1250 coupled to the handle 1232.

In operation, the coil actuator 1238 reciprocates the drive shaft 1240 along a vertical direction between retracted and extended positions, illustrated in FIGS. 46A and 46B, respectively. As the drive shaft 1240 moves from the retracted to the extended position, the applicator head extension 1244 is driven downwardly. The groove is forced along the projections 1250 to cause the applicator head to rotate in a clockwise direction when viewed from above. When the drive shaft 1240 travels in the upward direction, the applicator head extension 1244 and applicator head 1234 are rotated in a counter-clockwise direction as the applicator head 1234 travels vertically upward. Accordingly, the transmission coupling 1242 simultaneously generates rotating and axial oscillation of the applicator head 1234. It should be noted that, for any embodiment producing an axial movement of the applicator head, similar grooves and projections may be provided to rotate the head as it is driven axially with respect to the handle.

Figures 47A, 47B, 47C:
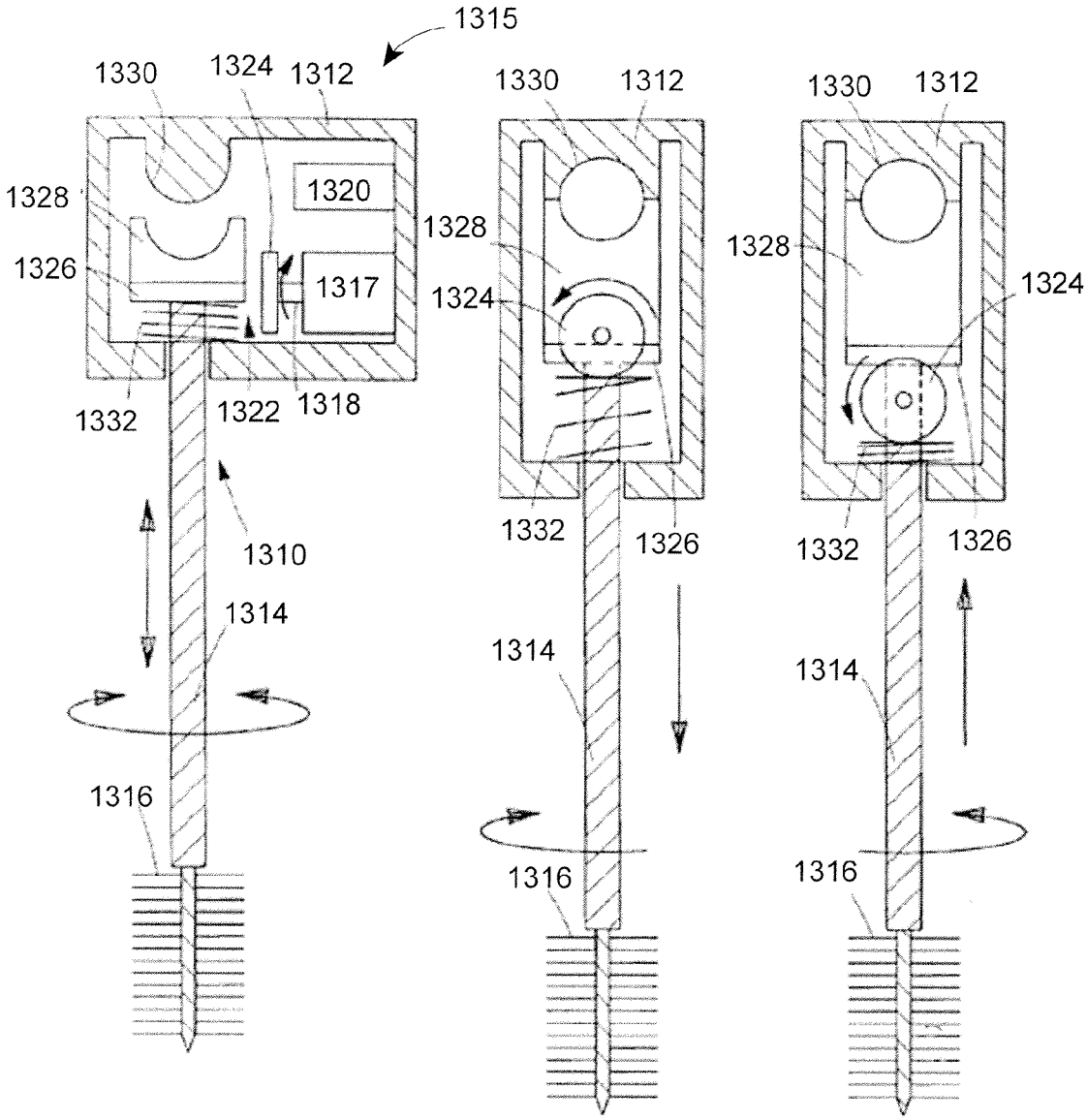
FIGS. 47A-C are cross-sectional views of an applicator with a drive that generates axial or vibrational motion and rotational motion.

Furthermore, the rotational motion of the applicator head 106 may be combined with axial or vibrational motion. For example, an exemplary embodiment of an applicator 1310 for producing rotational and axial or vibrational motion of the applicator head 106 is illustrated in FIGS. 47A-C. The applicator 1310 includes a handle 1312 and an applicator head 1314 with applicator elements 1316. The applicator 1310 includes a drive 1315, with a motor 1317 that is disposed in the handle 1312 and capable of rotating a motor shaft 1318 in at least one direction. A battery 1320 is also disposed in the handle 1312 and is operatively coupled to the motor 1317. A transmission 1322 is provided for operatively connecting the motor shaft 1318 to the applicator head 1314. The transmission 1322 includes a motor disc 1324 coupled to the motor shaft 1318. The motor disc 1324 frictionally engages a applicator head disc 1326 coupled to the applicator head 1314. A cam follower 1328 is coupled to the applicator head disc 1326 and shaped to engage a cam driver surface 1330 coupled to the handle 1312. A spring 1332 extends between the handle 1312 and the applicator head disc 1326 to bias the applicator head 1314 toward an upper position.

In operation, rotation of the motor disc 1324 rotates the applicator head disc 1326. As the applicator head disc 1326 rotates, the cam follower 1328 slides along the cam driver surface 1330 to simultaneously push the applicator head disc 1326 downwardly against the force of the spring 1332. As a result, the elevation of the applicator head disc 1326 moves above and below a center of rotation of the motor disc 1324 as it rotates. When the center of motor disc rotation is above the elevation of the applicator head disc 1326 as shown in FIG. 47B, the applicator head 1314 is rotated in a clockwise direction. Conversely, when the center of motor disc rotation is below the elevation of the applicator head disc 1326 as shown in FIG. 47C, the applicator head 1314 is rotated in a counter-clockwise direction. It will be appreciated that as the center of motor disc rotation moves farther away from the elevation of the applicator head disc 1326, the applicator head disc is rotated at a faster speed. Accordingly, the transmission coupling 1322 converts a uni-directional motor rotation into a rotating oscillation and an axial movement of the applicator head, in which the speed of rotation varies in both the forward and reverse rotation directions. The axial movement may be either an axial oscillation or a vibration of the applicator head.

Figure 48:
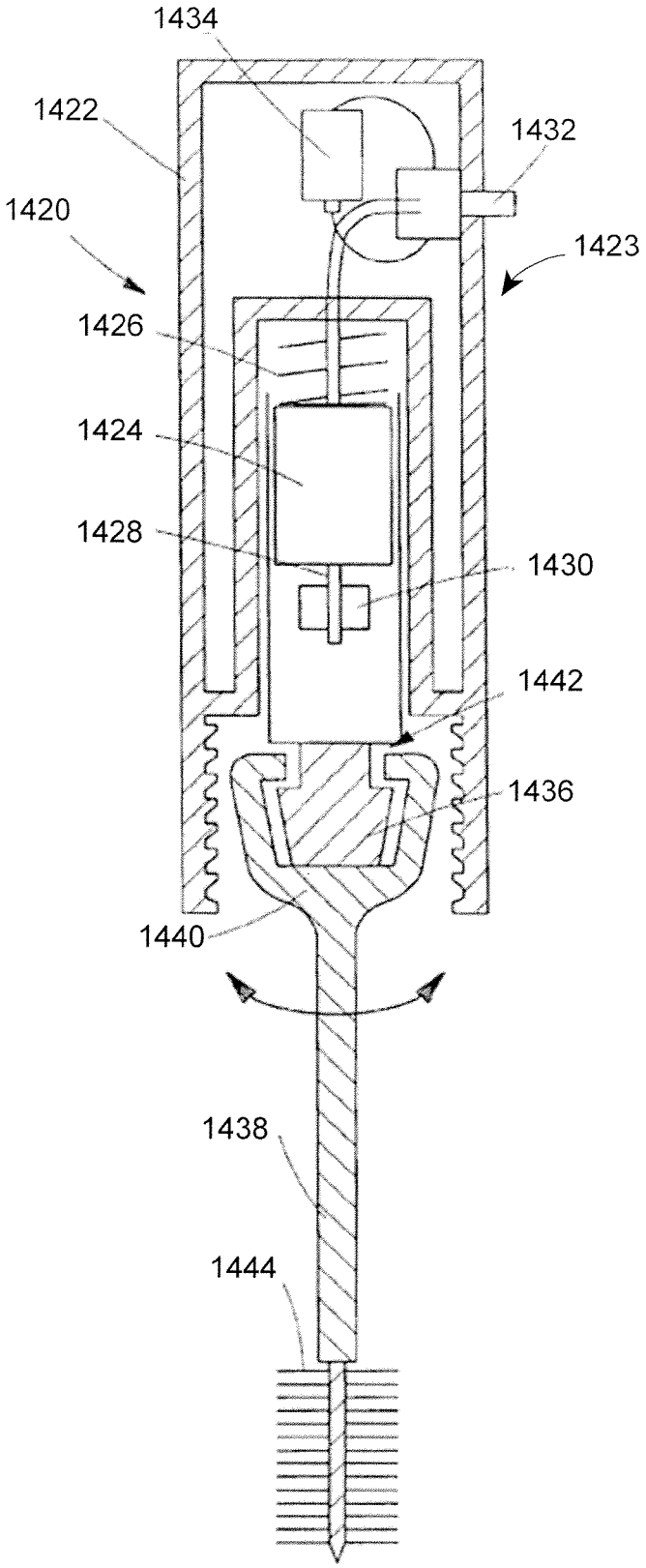
FIG. 48 is a cross-sectional view of an applicator with a drive that generates vibrational and rotational motion.

An applicator 1420 capable of producing a composite vibrational and rotational motion is illustrated at FIG. 48. The applicator 1420 includes a handle 1422 with a drive 1423 disposed therein. The drive 1423 includes a motor 1424 coupled to the handle 1422 through an isolation spring 1426. The motor has a motor shaft 1428 with a weight 1430 mounted eccentrically with respect to an axis of the motor shaft. A switch 1432 and battery 1434 are operatively coupled to the motor 1424. A boss 1436, which may have a generally cylindrical or frusto-conical shape, is also coupled to the handle 1422. A applicator head 1438 includes a applicator head extension 1440 defining a socket 1442 sized to rotatably engage the boss 1436. The applicator head 1438 also carries an applicator head 1444.

In operation, the rotating eccentric weight 1430 generates a vibratory force that is substantially isolated from the handle 1422 by the spring 1426. The force is transferred via the boss 1436 to the applicator head 1438, which causes the applicator head to rotate. In this embodiment, where the motor shaft 1428 is substantially parallel to the applicator head axis, rotation of the motor shaft 1428 in one direction causes rotation of the applicator head 1438 in the opposite direction. The direction of motor shaft rotation may be reversed by switching the polarity of the battery 1434. Accordingly, the applicator 1420 is capable of moving the applicator head 1444 in a composite motion including both a vibrational element and a rotational element.

Figure 49:
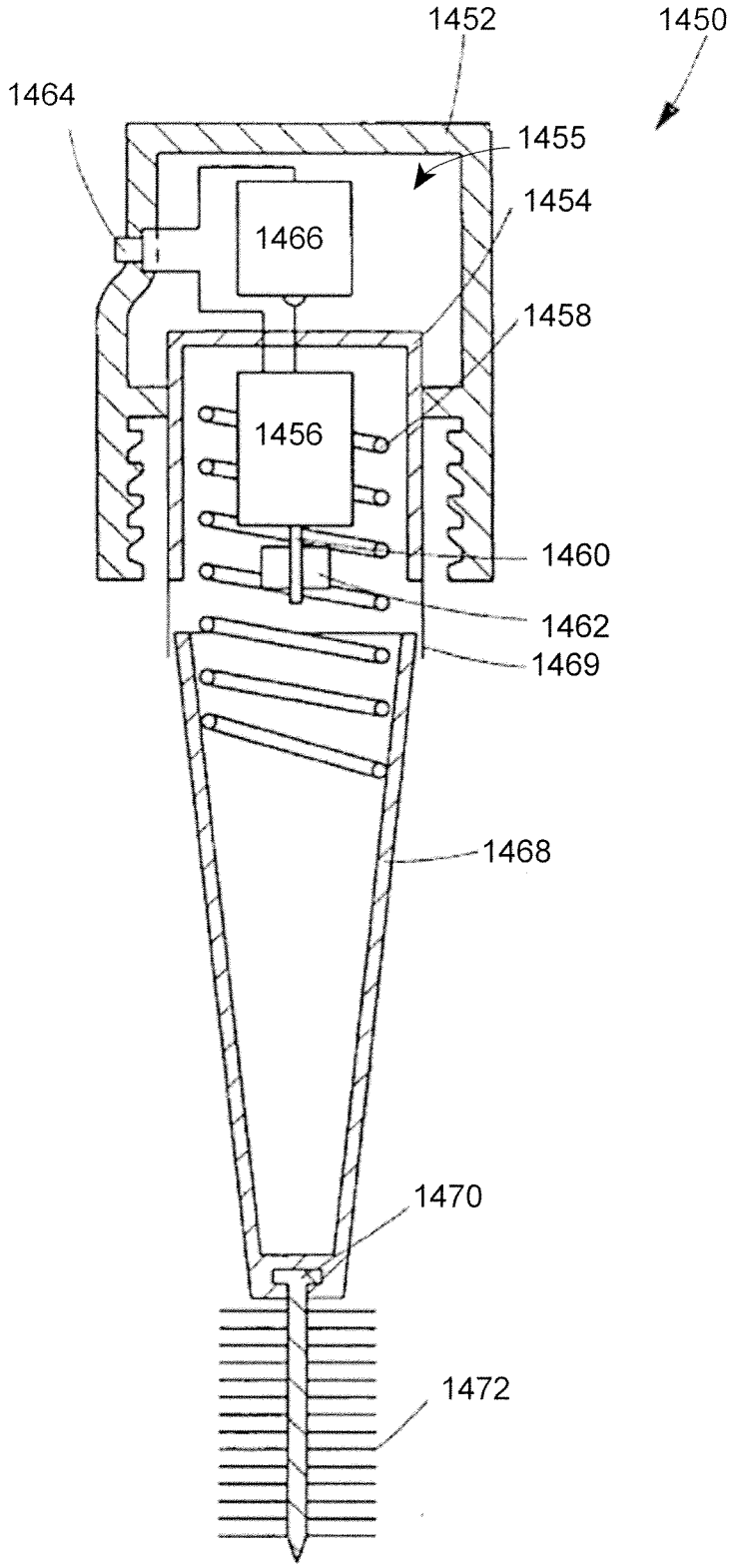
FIG. 49 is a cross-sectional view of an applicator with a drive that is capable of generating one or more of vibrational, radial and rotational motion.

An applicator 1450 capable of producing a composite applicator head motion including one or more vibrational, radial, and rotational components is illustrated in FIG. 49. The applicator 1450 includes a handle 1452 with an inner sleeve 1454 coupled thereto. The applicator 1450 also includes a drive 1455 with a motor 1456 supported inside the inner sleeve 1454 by a spring 1458. The motor 1456 includes a rotating shaft 1460 and an eccentrically mounted weight 1462 coupled thereto. A switch 1464 and a battery 1466 are operably coupled to the motor 1456. A hollow applicator head 1468 is sized to receive a free end of the spring 1458. The applicator head 1468 includes a socket 1470 sized to rotatably receive an applicator head 1472, so that the applicator head 1472 is free to rotate with respect to the applicator head 1468. A shroud 1469 may be provided to enclose a gap between opposing ends of the inner sleeve 1454 and the applicator head 1468.

In operation, rotation of the motor 1456 generates a rotational force that is isolated from the handle 1452 by one end of the spring 1458 and transferred to the applicator head 1468 by the other end of the spring 1458. The spring 1458 allows the applicator head 1468 to radially translated (i.e., to move in a circular path with respect to the inner sleeve 1454 without rotating). The applicator head 1472, in turn, is free to rotate with respect to the applicator head 1468. As a result, the applicator 1450 is capable of moving the applicator head 1472 in a composite motion including a radial translation component, a vibrational component, and/or a rotational component.

In the embodiments illustrated in FIGS. 48 and 49, the spring, motor, and eccentric weight may be selected to produce a desired frequency and amplitude for the applicator head motion. The spring may be matched to the motor and weight so that it is energized at or near its natural frequency. When so matched, the motor force is amplified by the spring and delivered to the applicator head, thereby reducing the power required by the motor to produce a given displacement of the applicator head.

Figure 50:
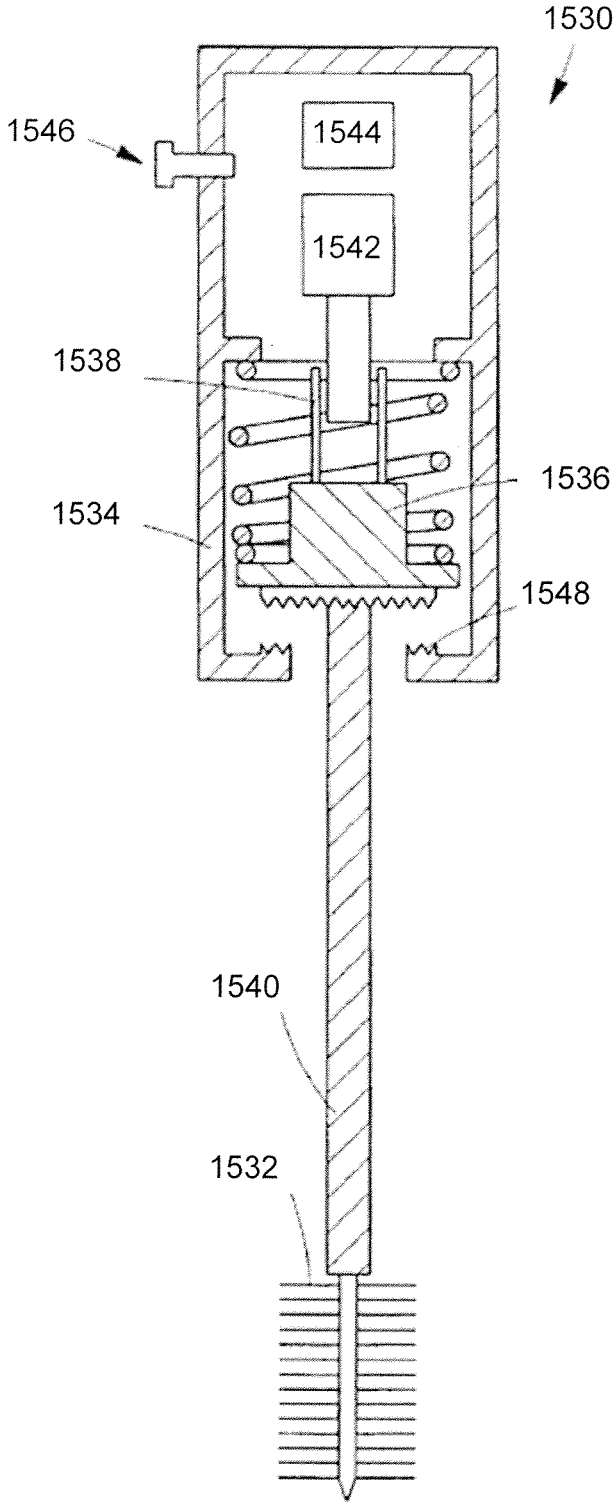
FIG. 50 is a cross-sectional view of an applicator with a drive that generates vibrational and rotational motion.

FIG. 50 illustrates another applicator 1530 for moving an applicator head 1532 with rotational and vibrational motion. The applicator 1530 includes a handle 1534. A toothed cam 1536 is disposed in the housing and includes a sleeve 1538. A applicator head 1540 is coupled to the toothed cam and carries the applicator head 1532. A motor 1542 includes a rotating shaft coupled to the sleeve 1538. A battery 1544 and switch 1546 are disposed in the handle 1534 and operatively coupled to the motor 1542. In operation, the motor 1542 rotates the cam 1536 over teeth 1548 formed in the housing to produce a composite applicator head motion having a rotational component and a vibrational component. The vibration is applied to the handle 1534 to provide tactile feedback to a user.

Figure 51A:
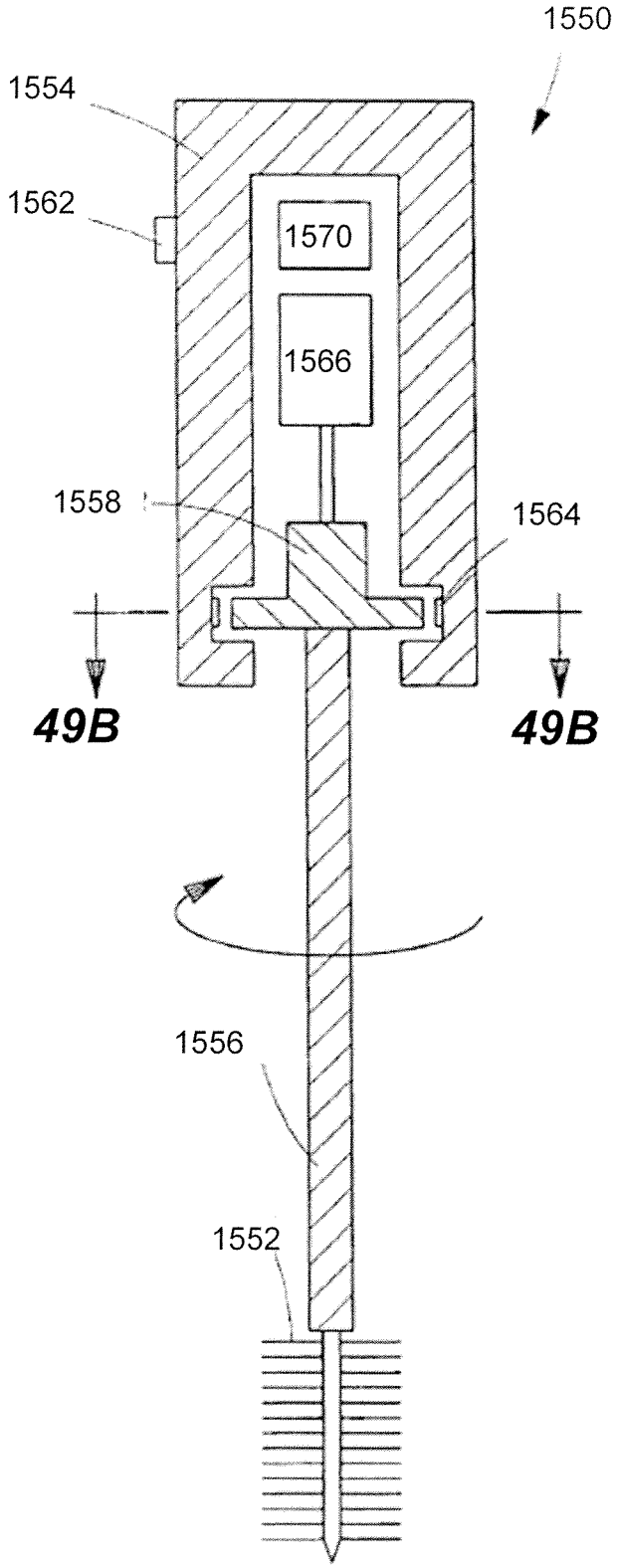
FIG. 51A is cross-sectional view of an applicator with a drive that generates vibrational and rotational motion.
Figure 51B:
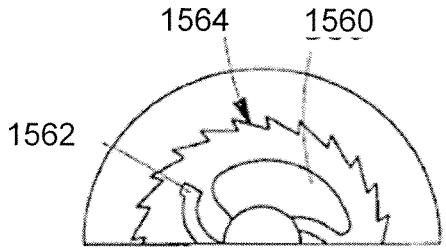
FIG. 51B is a fragmentary plan view of the drive illustrated in FIG. 51A.

FIGS. 51A and 51B illustrate an applicator 1550 with vibrational and rotational motion of the applicator head. The applicator 1550 includes a handle 1554. A applicator head 1556 includes a applicator head extension 1558 includes a stabilizing blades 1560 and teeth 1562 adapted to engage gear teeth 1564 coupled to the handle 1554. A motor 1566 is coupled to the applicator head extension 1558 and is operatively coupled to a battery 1570 and switch 1572. In operation, the motor 1566 rotates the applicator head extension 1558 to drive the teeth 1562 over the gear teeth 1564, thereby to generate a vibrational motion of the applicator head 1552. The vibration is passed through the handle 1554 to provide tactile feedback to a user.

An applicator may have an applicator head or combined applicator head and applicator head that may be independently removable from the handle to allow a variety of customized applicators to be used with the same handle. The removable head or head/applicator head combination may include a locking mechanism. The applicator head may further be adapted to provide a combination of both moving (i.e., rotating, axial moving, etc.) and stationary protrusions.

Assembly and Use of the Applicator

The applicator 100, according to any of the embodiments described above, may be manufactured as a single unit. That is, the applicator head 106 may be coupled to the drive 104 in such a fashion that attempts to decouple the applicator head 106 from the drive 104 may result in damage to one or both of the head 106 and the drive 104, rendering the head 106 and/or drive 104 inoperable. Alternatively, the applicator head and/or drive 104 may be coupled to the handle 102 to the same effect. The applicator 100 may be packaged and sold together with a bottle of the cosmetic, mascara for example.

However, the components of the applicator 100 may also be manufactured so as to be packaged and sold separately.

For example, the applicator head 106 may be selectively detachable from the drive 104 and/or handle 102, such that a variety of heads 106 may be used with a given drive 104 and handle 102. After this fashion, the user may be permitted to change between applicator heads 106 having different applicator element profiles (see FIG. 29A-V, for example) or applicator element distributions (see FIGS. 33A-M, for example) without the need to obtain or purchase more than a single drive 104/handle 102 unit. According to these embodiments, one or more applicator heads 106 and a drive 104/handle 102 unit may be packaged and sold as a kit, and applicator heads 106 may be packaged and sold separately from a drive 104/handle 102 as refills or replacements for the drive 104/handle 102 units.

Figure 52:
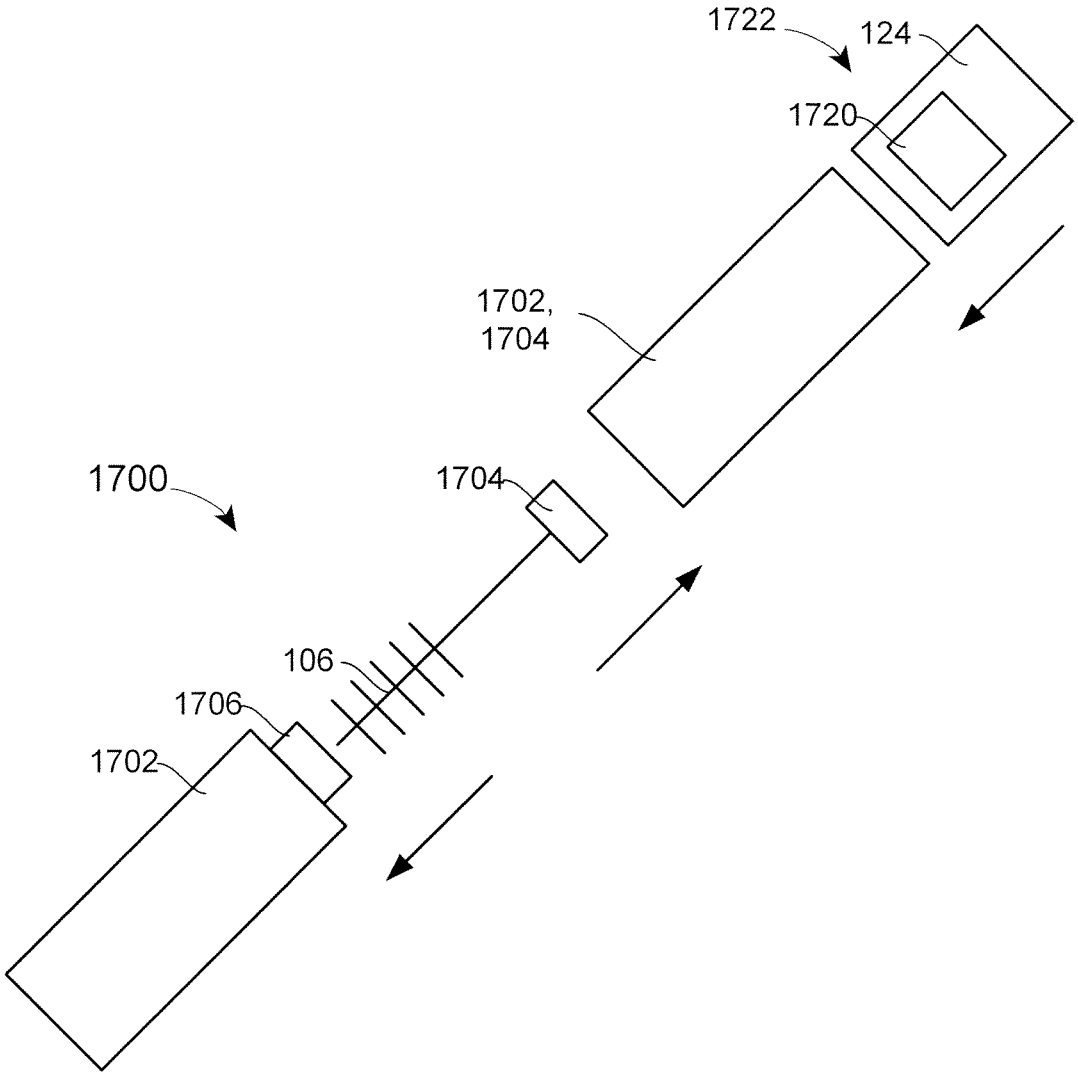
FIG. 52 is a schematic of a kit including an applicator according to one or more of the forgoing embodiments.

Moreover, following along these lines, the applicator head 106 may be packaged and sold as a unit 1700 with the a bottle of cosmetic material (for example, mascara) 1702, as shown in FIG. 52. For example, the applicator head 106 may include a threaded portion 1704 that engages a similarly threaded portion 1706 of the bottle 1702. The head 106 may then be coupled to the drive 104/handle 102 at the time of use. The drive 104/handle 102 could be packaged and sold with the combination 1700 of the head 106 and bottle 1702 as part of a kit, or the drive 104/handle 102 could be packaged and sold separately from the head 106/bottle 1702.

It will be recognized that the head 106 is not the only component of the applicator that may be packaged and sold separately. For example, as also illustrated in FIG. 52, the power source 124 may be selectively detachable from the remainder of the drive 104. Furthermore, the power source 124 may be coupled with a drive circuit 1720 to form a type of intelligent power source 1722 that may not only provide voltage and current to the motor 120, but also may control the speed of the applicator head 106 to provide a non-fixed rotational speed, such as shown in FIGS. 41 and 42, or provide some other control function (directionality of motion, for example). After this fashion, selection and combination of the intelligent power source 1722 with the remainder of the drive 104 may significantly influence the performance of the applicator 100.

All documents cited in the Detailed Description are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A mascara applicator comprising:

a handle;

a drive coupled to the handle;

an applicator head coupled to the drive by a first shaft and a second shaft that are aligned along a common axis, the applicator head comprising an applicator surface and a plurality of applicator elements that extend radially away from the applicator surface, the applicator elements being configured to separate keratinous fibers and apply a mascara composition thereto; and a torque limiter comprising a magnetic coupling, the magnetic coupling including a first magnet and a second magnet, the first magnet being coupled to one of the first and second shafts, the second magnet being coupled to the other of the first and second shafts, and the first and second magnets being magnetically coupled to each other such that the torque limiter prevents the torque applied via the applicator head from exceeding a predetermined allowable torque that is from 0.05 to 5 ounce inches;

wherein the applicator head is configured to be driven by the drive and to rotate at a speed of 1-200 rpm.

2. The cosmetic applicator according to claim 1, wherein the drive comprises an electric motor.

3. The cosmetic applicator according to claim 1, wherein the drive comprises a mechanical motor.

4. The cosmetic applicator according to claim 1, wherein the magnetic coupling is coupled between the applicator head and the drive to transmit motion between the drive and the applicator head.

5. The cosmetic applicator according to claim 1, wherein the magnetic coupling comprises at least one electromagnet.

6. The cosmetic applicator according to claim 1, wherein the magnetic coupling comprises at least one permanent magnet.

7. The cosmetic applicator according to claim 1, wherein the first and second magnets are aligned along a common axis in a first, coupled state, and aligned along parallel axes in a second, decoupled state.

8. The cosmetic applicator according to claim 1, wherein the first and second magnets are disposed with opposing surfaces of the first and second magnets abutting.

9. The cosmetic applicator according to claim 8, at least one of the opposing surfaces of the first and second magnets comprising a coating having a static coefficient of friction and a kinetic coefficient of friction.

10. The cosmetic applicator according to claim 1, wherein the first and second magnets are disposed with a gap therebetween, and wherein the magnetic coupling comprises a spacer disposed in the gap.

11. The cosmetic applicator according to claim 10, wherein the spacer comprises a first layer and a second layer, the first and second layers having opposing surfaces frictionally coupled to each other.

12. A mascara applicator comprising:

a handle;

a drive coupled to the handle;

an applicator head coupled to the drive by a first shaft and a second shaft that share a common axis, the applicator head comprising an applicator surface and a plurality of applicator elements that extend radially away from the applicator surface, the applicator elements being configured to separate keratinous fibers and apply a mascara composition thereto; and a torque limiter comprising a magnetic coupling, the magnetic coupling including a first magnet and a material having a medium to high magnetic permeability, the first magnet being coupled to one of the first and second shafts, the material being coupled to the other of the first and second shafts, and the first magnet and the material being magnetically coupled to each other such that the torque limiter prevents the torque applied via the applicator head from exceeding a predetermined allowable torque that is from 0.05 to 5 ounce inches;

wherein the applicator head is configured to be driven by the drive and to rotate at a speed of 1-200 rpm.

13. The cosmetic applicator according to claim 12, wherein the material comprises iron.

14. The applicator of claim 12, wherein the predetermined allowable torque is from 0.1 to 2 ounce inches.

15. The applicator of claim 12, wherein the predetermined allowable torque is from 0.5 to 1.5 ounce inches.

16. The applicator of claim 12, wherein the applicator head is configured to rotate at a speed of 10-60 rpm.

17. The applicator of claim 1, wherein the predetermined allowable torque is from 0.1 to 2 ounce inches.

18. The applicator of claim 1, wherein the predetermined allowable torque is from 0.5 to 1.5 ounce inches.

19. The applicator of claim 1, wherein the applicator head is configured to rotate at a speed of 5-100 rpm.

20. The applicator of claim 1, wherein the applicator head is configured to rotate at a speed of 10-60 rpm.

* * * * *